US006232587B1

(12) United States Patent
Kurita et al.

(10) Patent No.: US 6,232,587 B1
(45) Date of Patent: May 15, 2001

(54) MICROWAVE HEATING APPARATUS WITH A VAPOR GENERATOR AND REGENERATING PLATES

(75) Inventors: Hitoshi Kurita, Yamatokoriyama; Yutaka Takahashi, Nara; Keijirou Kunimoto, Nabari; Ikuhiro Inada, Yamatokoriyama; Satomi Uchiyama, Nara; Shigeki Ueda, Yamatokoriyama, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/254,080

(22) PCT Filed: Aug. 29, 1997

(86) PCT No.: PCT/JP97/03024

§ 371 Date: Mar. 2, 1999

§ 102(e) Date: Mar. 2, 1999

(87) PCT Pub. No.: WO98/10228

PCT Pub. Date: Mar. 12, 1998

(30) Foreign Application Priority Data

| | | |
|---|---|---|
| Sep. 3, 1996 | (JP) | 8-232655 |
| Oct. 9, 1996 | (JP) | 8-268105 |
| Dec. 3, 1996 | (JP) | 8-322551 |
| Dec. 4, 1996 | (JP) | 8-323776 |

(51) Int. Cl.[7] ..... H05B 6/68; H05B 6/80

(52) U.S. Cl. ..... 219/682; 219/702; 219/710; 219/688; 219/759; 219/401; 219/629

(58) Field of Search ..... 219/682, 687, 219/688, 759, 756, 757, 628, 629, 630, 401, 702, 710

(56) References Cited

U.S. PATENT DOCUMENTS

| | | | | |
|---|---|---|---|---|
| 4,165,455 | * | 8/1979 | Mayfield | 219/688 |
| 4,366,357 | * | 12/1982 | Satoh | 219/682 |
| 4,622,446 | * | 11/1986 | Sugisawa et al. | 219/756 |
| 4,803,324 | | 2/1989 | Fujii et al. . | |
| 4,826,575 | * | 5/1989 | Karamian | 219/688 |
| 5,026,957 | | 6/1991 | Pralus . | |
| 5,338,409 | * | 8/1994 | Heierli | 219/687 |
| 5,525,782 | * | 6/1996 | Yoneno et al. | 219/682 |
| 5,786,577 | * | 7/1998 | Han et al. | 219/682 |
| 6,008,482 | * | 12/1999 | Takahashi et al. | 219/687 |

FOREIGN PATENT DOCUMENTS

| | | |
|---|---|---|
| 54-127769 | 10/1979 | (JP) . |
| 55-6790 | 1/1980 | (JP) . |
| 55-119501 | 8/1980 | (JP) . |
| 07111189 | 4/1995 | (JP) . |

OTHER PUBLICATIONS

English translation of International Search Report.

* cited by examiner

*Primary Examiner*—Philip H. Leung
(74) *Attorney, Agent, or Firm*—Michael K. Kelly; Snell & Wilmer L.L.P.

(57) ABSTRACT

A microwave heating apparatus includes a heating chamber 3 for accommodating an item 2 to be heated; a microwave generator 11 for radiating microwaves to the heating chamber 3, and a vapor generator 12 for supplying vapor to the heating chamber 3. The heating chamber 3 includes regenerating plates 28*a* and 28*b* for generating and regenerating heat when radiated by the microwaves from the microwave generator 11, thereby reducing dew condensation caused by the vapor in the heating chamber 3.

24 Claims, 23 Drawing Sheets

MICROWAVE HEATING APPARATUS WITH A VAPOR GENERATOR AND REGENERATING PLATES

TECHNICAL FIELD

The present invention relates to a microwave heating apparatus for quickly heating and cooking food while maintaining the quality of the food.

BACKGROUND ART

FIG. 22 shows a structure of a conventional microwave heating apparatus including a vapor generator.

A main body 1 of the microwave heating apparatus (hereinafter, referred to simply as the "main body 1") includes a heating chamber 3 for accommodating an item 2 to be heated (hereinafter, referred to simply as the "item 2"), a magnetron 4 provided outside the heating chamber 3, and a vapor generator 5 for generating vapor 10 to be supplied to the heating chamber 3. The vapor generator 5 includes a vapor generating chamber 6 and a water supply tank 7 in communication with the vapor generating chamber 6.

The item 2 is heated for cooking by microwaves 8 generated by the magnetron 4 and the vapor 10 supplied to the heating chamber 3 from the vapor generating chamber 6. The vapor generating chamber 6 generates heat by an electric current induced by an induction heating coil 9 and thus generates the vapor 10.

By heating the item 2 using both the microwaves 8 and the vapor 10, the moisture is maintained in the item 2 more than in the case where only the microwaves 8 is used for heating. Moreover, the vapor 10 heats the item 2 uniformly and thus more satisfactorily.

However, the conventional microwave heating apparatus has the following problems.

The microwave heating apparatus requires 2 to 4 minutes to start up, i.e., from the time the induction heating coil 9 is activated until the vapor 10 is generated, as shown in FIG. 23. This prolongs the cooking time. For 1 to 2 minutes after the induction heating coil 9 is deactivated, the vapor 10 is still being supplied to the heating chamber 3. This can cause some danger when taking the cooked item 2 out from the heating chamber 3.

Furthermore, when the vapor 10 is supplied to the heating chamber 3, the vapor 10 contacts the walls of the heating chamber 3 and thus generates dew condensation. The microwaves 8 are absorbed by the dew condensation, thereby causing non-uniformity in the electric wave distribution in the heating chamber 3. Thus, uniform heating by the microwaves 8 is not realized.

The dew condensation also tends to de-sanitize the heating chamber 3.

The present invention has an objective of providing a microwave heating apparatus for heating and cooking an item by reducing the dew condensation in a heating chamber.

The present invention has another objective of providing a microwave heating apparatus for heating and cooking an item, which supplies high-speed vapor corresponding to the microwaves so as to realize quicker cooking, more safety in removing the cooked item with no vapor remaining in the heating chamber, and a reduction in dew condensation in the heating chamber.

DISCLOSURE OF THE INVENTION

According to one aspect of the invention, a microwave heating apparatus includes a heating chamber for accommodating an item to be heated; a microwave generator for radiating microwaves to the heating chamber, and a vapor generator for supplying vapor to the heating chamber. The heating chamber includes a regenerating plate for generating and regenerating heat when radiated by the microwaves from the microwave generator, thereby reducing dew condensation caused by the vapor in the heating chamber.

In one embodiment of the invention, the vapor generator includes an excitation coil provided outside a vapor generating chamber and a metal body provided inside the vapor generating chamber which is made of one of foam and fiber. Water from a water supply tank is drip-fed onto a top end of the metal body.

In one embodiment of the invention, the regenerating plate is provided on at least one of top, bottom, left, right and inner rear walls included in the heating chamber.

In one embodiment of the invention, the regenerating plate is on at least one of an upper position and a lower position with respect to a position at which the item to be heated is located in the heating chamber.

In one embodiment of the invention, a microwave heating apparatus further includes a control section for pre-heating the regenerating plate to a prescribed temperature by operating the microwave generator prior to a supply of the vapor to the heating chamber from the vapor generator.

In one embodiment of the invention, a vapor spraying outlet is provided for releasing the vapor upward from a lower position in the heating chamber.

In one embodiment of the invention, supporting plate is provided for covering a side wall of the heating chamber and supporting ends of the regenerating plate, and the regenerating plate has a vapor direction guide formed thereon for releasing the vapor upward to a position corresponding to a vapor spraying outlet formed at a lower position of the side wall of the heating chamber.

In one embodiment of the invention, a length of the regenerating plate in a depth direction is shorter than a length of the heating chamber in the depth direction, and the heating chamber is structured so that air warmed by cooling a magnetron of a microwave generator flows in through a gap between at least one of the walls of the heating chamber and the regenerating plate which is set in the heating chamber.

In one embodiment of the invention, a vapor spraying outlet formed at the lower position on a side wall of the heating chamber is connected to an outlet of a boiler of the vapor generator, and a lower level of the vapor spraying outlet is lower than a lower level of the outlet of the boiler.

In one embodiment of the invention, the regenerating plate includes a plate formed of one of ceramics or porcelain and a glaze layer formed on a surface of the plate, the glaze layer generates heat when radiated by the microwaves, and the plate regenerates the heat which is generated by the glaze layer.

In one embodiment of the invention, a microwave heating apparatus further includes a control section for pre-heating the heating chamber to a first target temperature by operating the microwave generator prior to the generation of the vapor generator when detecting a pre-heating start instruction while being in a wait state, and also for pre-heating the heating chamber to a second target temperature which is lower than the first target temperature when not detecting any action during a prescribed time period.

In one embodiment of the invention, the vapor generating chamber includes a diffusive member for diffusing water drip-fed from the water supply tank.

In one embodiment of the invention, the diffusive member includes an end surface diffusive member provided at an end surface of the metal body and an outer peripheral wall diffusive member provided on an outer peripheral wall of the metal body.

In one embodiment of the invention, the outer peripheral wall diffusive member is formed of long-fiber assembly having an ability of absorbing liquid and an ability of retaining liquid.

In one embodiment of the invention, the metal body includes a hollow space. A shaft member is inserted into the hollow space for preventing water drip-fed from the water supply tank from flowing down from the hollow space without being vaporized.

In one embodiment of the invention, the shaft member is a rolled cylindrical member which has a sufficient spring property to vary an outer diameter thereof.

In one embodiment of the invention, the vapor generator is structured so as to pump the water up into the water supply tank by a pump through a water processing material cartridge attached to the water supply tank.

In one embodiment of the invention, a microwave heating apparatus further includes a control section for determining time to exchange the water processing material cartridge based on the operation time of the vapor generator or the operation time of the pump for pumping up the water from the water supply tank, or the result of accumulation of amount of supplied water, and for notifying the time to exchange.

In one embodiment of the invention, a microwave heating apparatus further includes a control section for stopping the operation of the pump by detecting that the time to exchange the water processing material cartridge is approaching and for allowing the operation of the pump only during a prescribed time period by detecting an input operation for instructing a re-start while the operation of the pump is stopped.

In one embodiment of the invention, a microwave heating apparatus further includes an input device for inputting a set value for the time to exchange the water processing material cartridge.

In one embodiment of the invention, a microwave heating apparatus further includes a control section for notifying water supply when a water level detector detects that a water level in the water supply tank has reached a detection level and for still continuing the operation of the vapor generator for a prescribed time period.

In one embodiment of the invention, the water level detector includes a float having a buried magnet mounted in the water supply tank and a lead switch provided at a position separated from the water supply tank.

In one embodiment of the invention, the detection level is above an inlet of the water processing material cartridge attached to the water supply tank.

In one embodiment of the invention, a waste water tank is provided at a lower position of a main body of the microwave heating apparatus for receiving water from the dew condensation in the heating chamber and the water discharged from the boiler of the vapor generator.

BEST MODE FOR CARRYING THE INVENTION

Hereinafter, the present invention will be described by way of illustrative examples with reference to the accompanying drawings.

Figure 1:
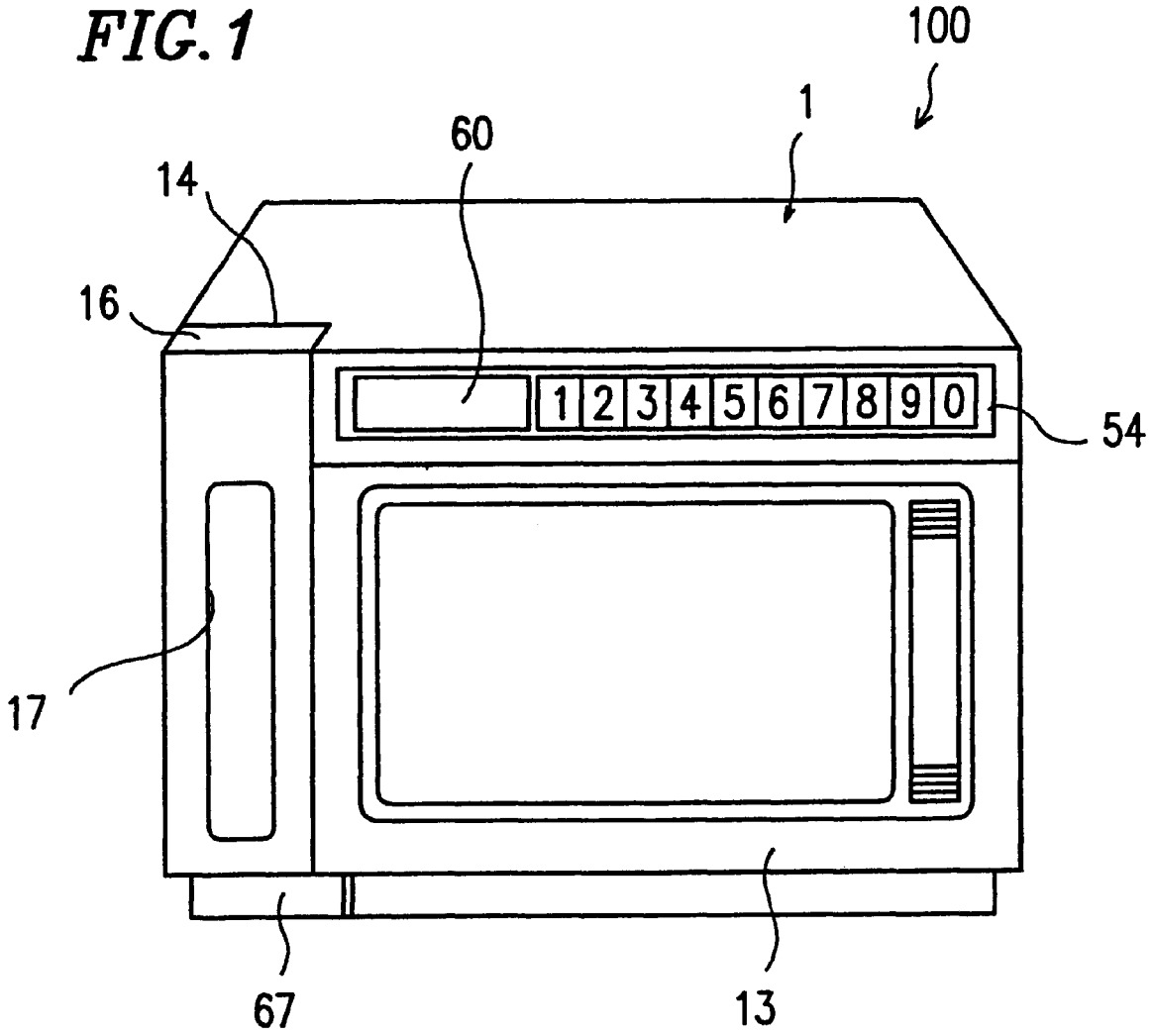
FIG. 1 is an external view of a microwave heating apparatus in an example according to the present invention.
Figure 2:
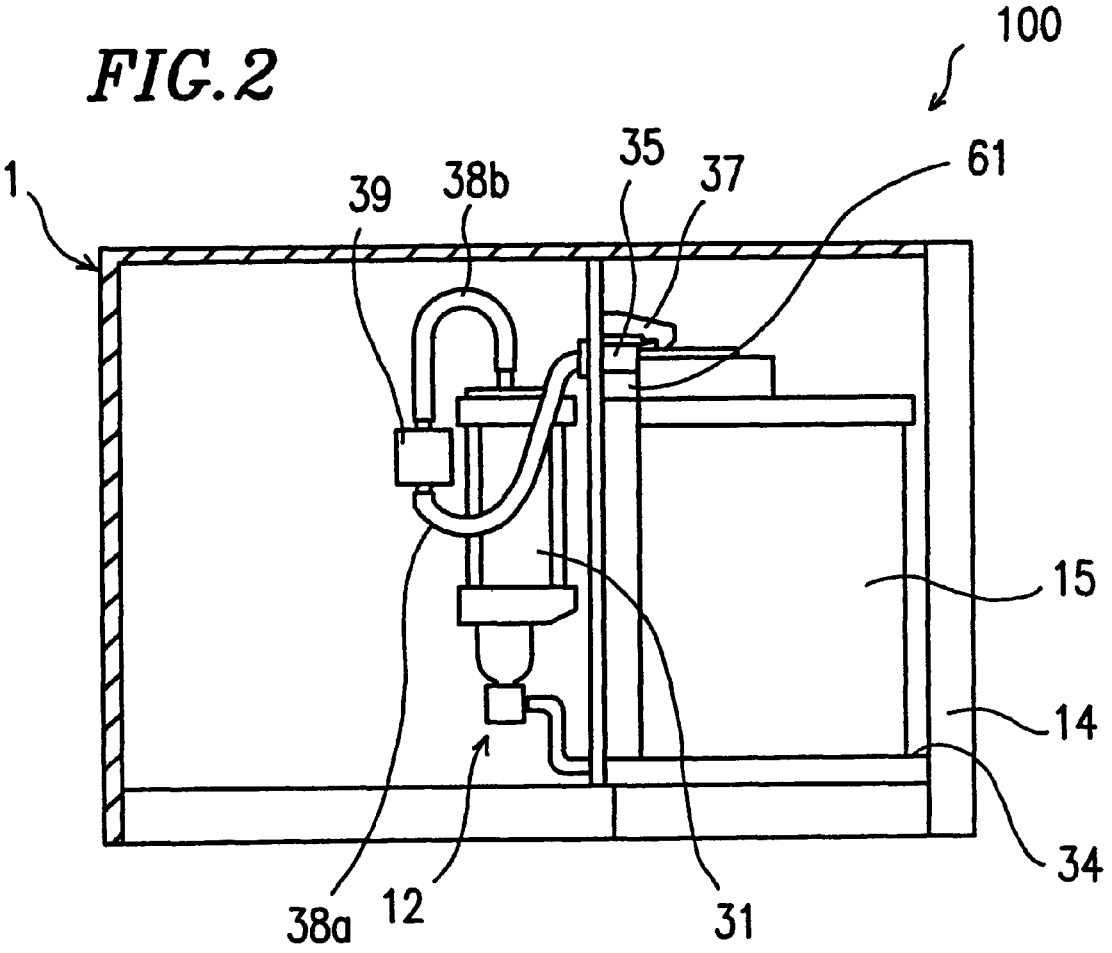
FIG. 2 is a left side view of the microwave heating apparatus shown in FIG. 1.
Figure 3:
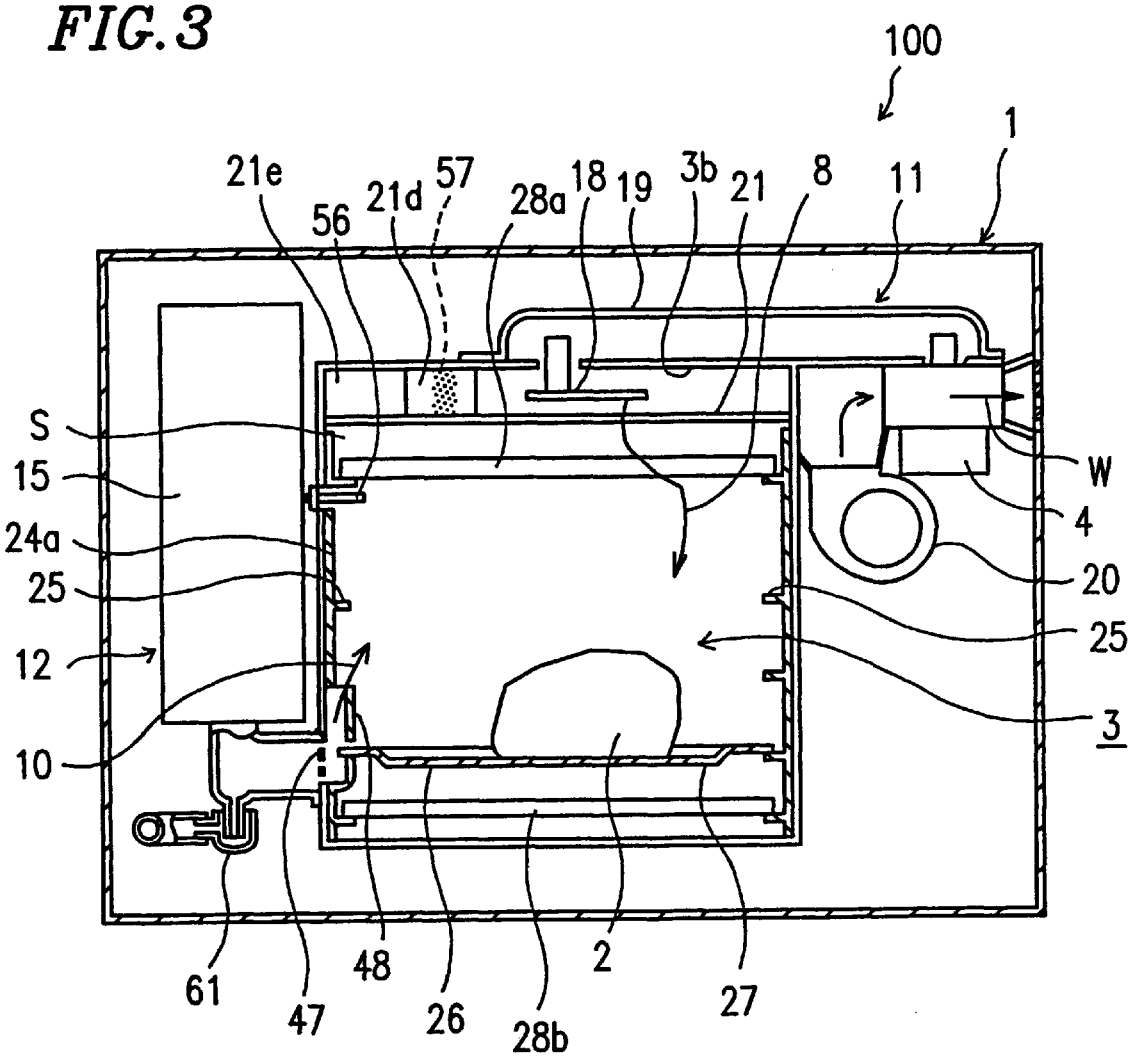
FIG. 3 is a cross-sectional view of the microwave heating apparatus shown in FIG. 1 seen from the front side thereof.

As shown in FIGS. 1, 2 and 3, a main body 1 of a microwave heating apparatus 100 (hereinafter, referred to simply as the "main body 1") includes a heating chamber 3 for accommodating an item 2 to be cooked (hereinafter, referred to simply as the "item 2"), a microwave generator 11 for radiating microwaves toward the heating chamber 3, and a vapor generator 12 for generating vapor to be supplied to the heating chamber 3.

A first door 13 is attached to the main body 1 to be allowed to be opened and closed. The first door 13 is opened and closed so as to put in and take out the item 2 from the heating chamber 3. A second door 14 is attached to the main body 1 to be allowed to be opened and closed. The second door 14 is opened and closed around a shaft 16 so as to attach and detach a water supply tank 15 to and from the vapor generator 12. The second door 14 has a window 17 to allow the user to visually check the water level in the water supply tank 15.

The microwave generator 11 includes a magnetron 4 provided outside the heating chamber 3, an antenna 18 provided on the ceiling of the heating chamber 3, and a waveguide 19 for supplying the microwaves generated by the magnetron 4 to the antenna 18. The magnetron 4 is forcibly cooled by a fan 20.

Figure 4:
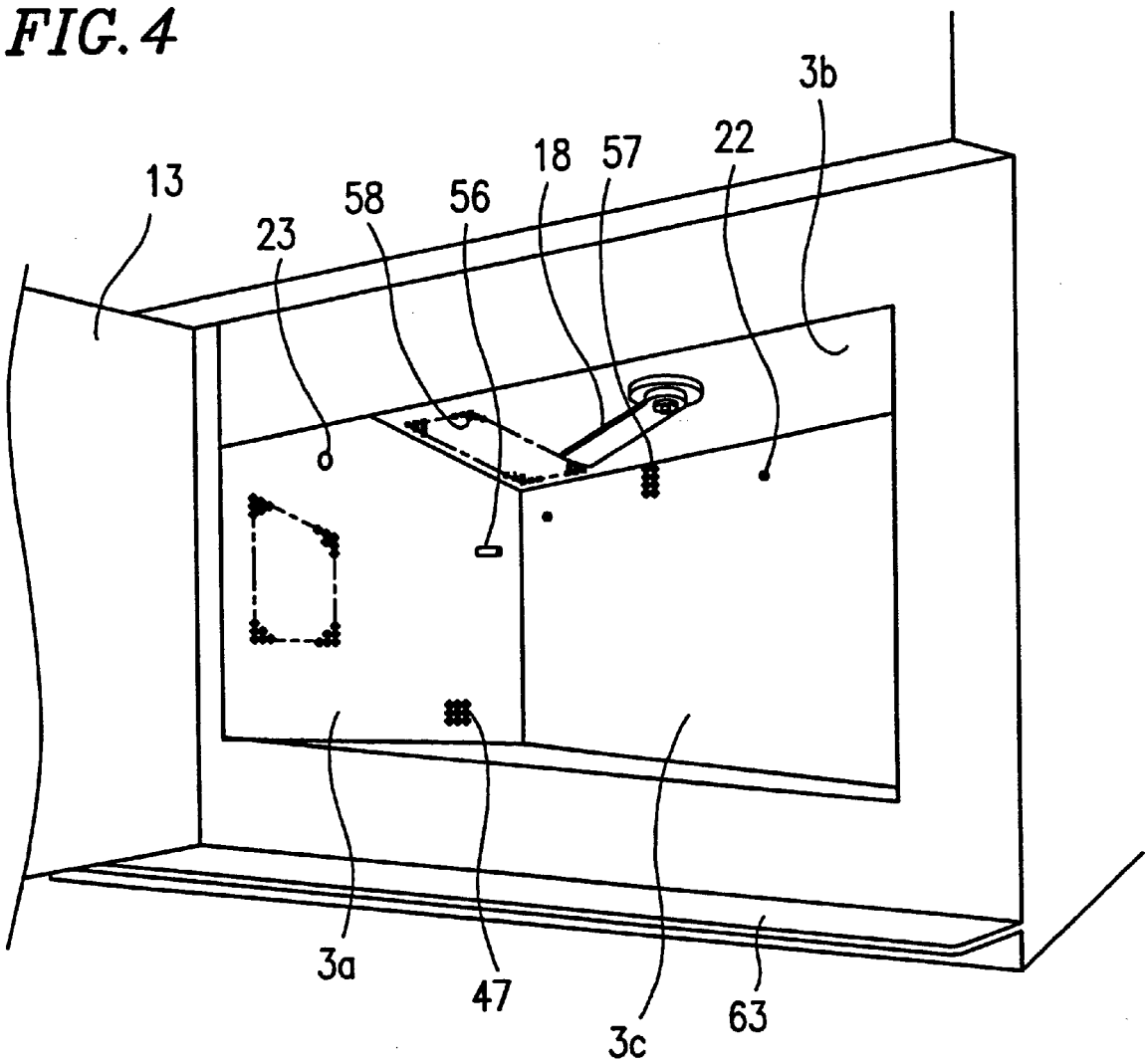
FIG. 4 is an isometric view of a heating chamber of the microwave heating apparatus shown in FIG. 1 in the state where components are removed.

FIG. 4 shows an inner structure of the heating chamber 3. As shown in FIG. 4, the heating chamber 3 has top and bottom walls, two side walls, and an inner rear wall. The inner rear wall has holes 22 in an upper part thereof. The two side walls each have a hole 23 in an upper part thereof. These walls in the heating chamber 3 are made of stainless steel and shaped like a box.

Figure 5:
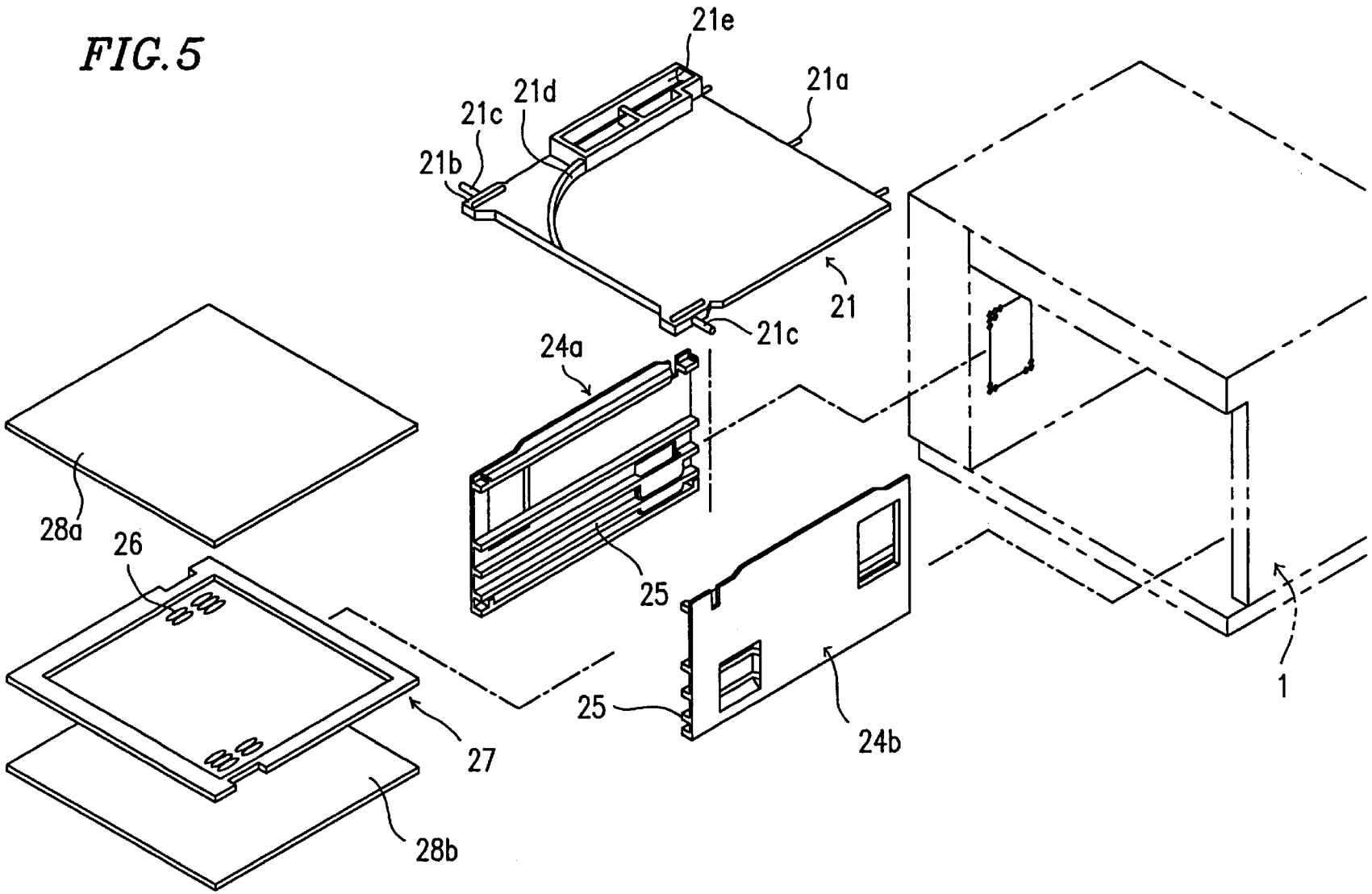
FIG. 5 is an exploded isometric view of the components of the heating chamber.

FIG. 5 shows components of the heating chamber 3. The components are assembled in the following order.

First, in the state where the first door 13 is opened, a top plate 21 is set at a prescribed position in the heating chamber 3. The top plate 21 is set so as not to expose the antenna 18 (FIG. 4). The top plate 21 has projections 21*a* and elastic parts 21*b*. The projections 21*a* are provided on a rear side thereof, and the elastic parts 21*b* are integrally formed at both two sides of the front of the top plate 21. The elastic parts 21*b* each have a projection 21*a*. The top plate 21 is set at the prescribed position in the heating chamber 3 by inserting the projections 21*a* into the holes 22 (FIG. 4) in the inner rear wall of the heating chamber 3 and inserting the projections 21*a* into the holes 23 (FIG. 4) formed on the side walls of the heating chamber 3.

Figure 6:
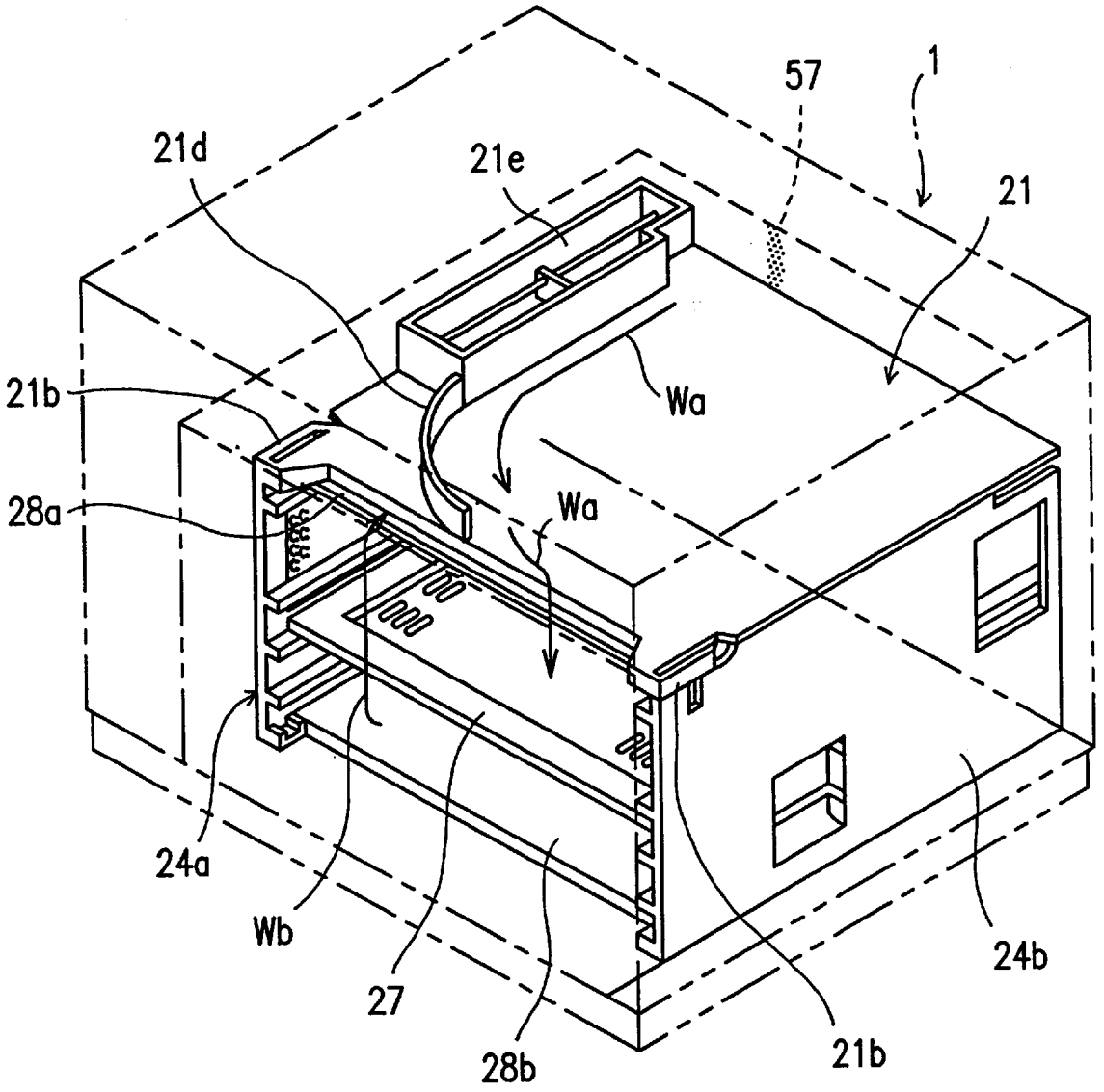
FIG. 6 is an isometric view of the heating chamber in the state where the components are assembled.

Next, supporting plates 24*a* and 24*b* are set at prescribed positions along the side walls in the heating chamber 3. The top ends of the supporting plates 24*a* and 24*b* engage the elastic parts 21*b* of the top plate 21 (FIG. 6). The supporting plates 24*a* and 24*b* have supporting rails 25 integrally formed thereon.

The supporting plates 24*a* and 24*b* are identical in shape for convenience in use.

A plate 27 has a plurality of holes 26. The plate 27 is inserted into the heating chamber 3 along the supporting rails 25 of the supporting plates 24*a* and 24*b*. The item 2 (FIG. 3) is to be placed on the plate 27.

A regenerating plate 28*a* is set at a prescribed position in the heating chamber 3 above the plate 27 (FIG. 6). A regenerating plate 28*b* is set at a prescribed position in the heating chamber 3 below the plate 27 (FIG. 6).

Figure 7:
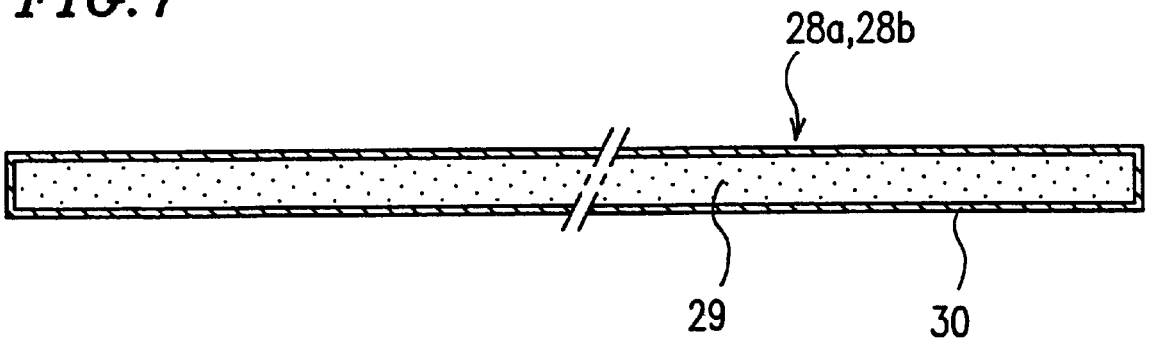
FIG. 7 is a cross-sectional view of a regenerating plate.

FIG. 7 shows a structure of the regenerating plates 28*a* and 28*b*. The regenerating plates 28*a* and 28*b* are each formed by baking a ceramic (or porcelain) plate 29 having glaze 30 applied thereon. The ceramic (or porcelain) plate 29 can be, for example, mullite quartz ceramic. The regenerating plates 28*a* and 28*b* each includes the ceramic (or porcelain) plate 29 and the layer of glaze 30 formed on a surface of the ceramic (or porcelain) plate 29. When the microwaves are radiated to the regenerating plates 28*a* and 28*b*, the layer of the glaze 30 generates heat. Such heat is regenerated by the ceramic or porcelain plate 29.

Figure 8:
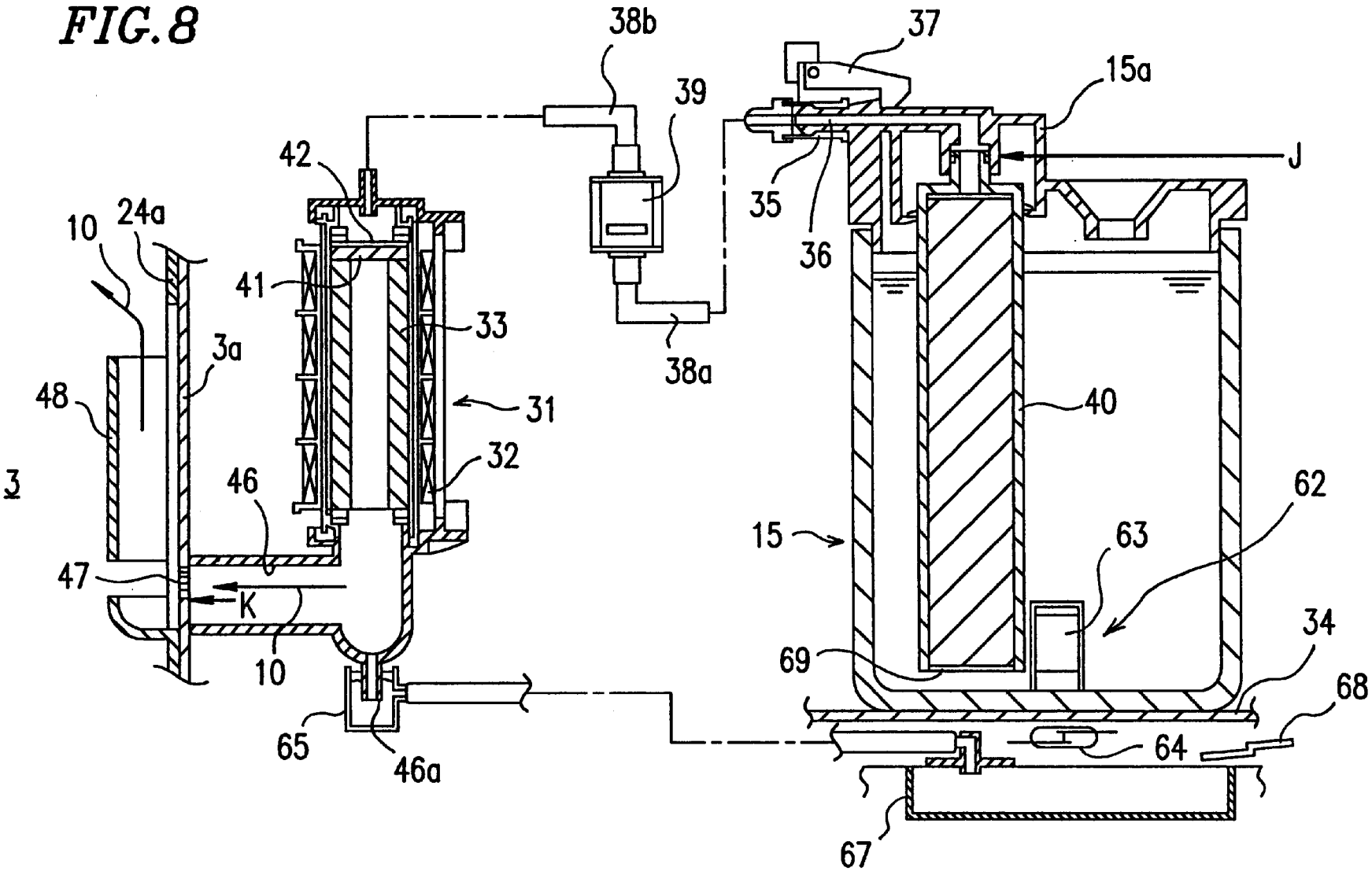
FIG. 8 is a view illustrating the structure of a vapor generator.

FIG. 8 shows a structure of a vapor generator 12. The vapor generator 12 includes a vapor generating chamber (boiler) 31 attached to the main body 1, a magnetic excitation coil 32 wound around the boiler 31, a foam or fiber metal body 33 provided inside the boiler 31, and the water supply tank 15 detachable with respect to the main body 1.

The water supply tank 15 is attached to the main body 1 in the following manner.

The second door 14 (FIG. 1) is opened, and the water supply tank 15 is inserted while being put on a bottom plate 34. Thus, a nozzle 36 of the water supply tank 15 is inserted into a connection opening 35 provided on the main body 1. A hook 37 attached to the main body 1 engages the water supply tank 15, thereby restricting the movement of the water supply tank 15. In this manner, the water supply tank 15 is attached to the main body 1.

The connection opening 35 is connected to an inlet of a pump 39 through a tube 38*a*. An outlet of the pump 39 is connected to a top end of the boiler 31 through a tube 38*b*. Due to such a system, water from the water supply tank 15 is drip-fed onto the metal body 33.

A water processing material cartridge (ion exchange resin cartridge) 40 is attached to the water supply tank 15. When the pump 39 is operated, the water in the water supply tank 15 is pumped up through the water processing material cartridge 40. Thus, water is supplied to the boiler 31 excluding any scale component (contained in tap water).

Figure 9:
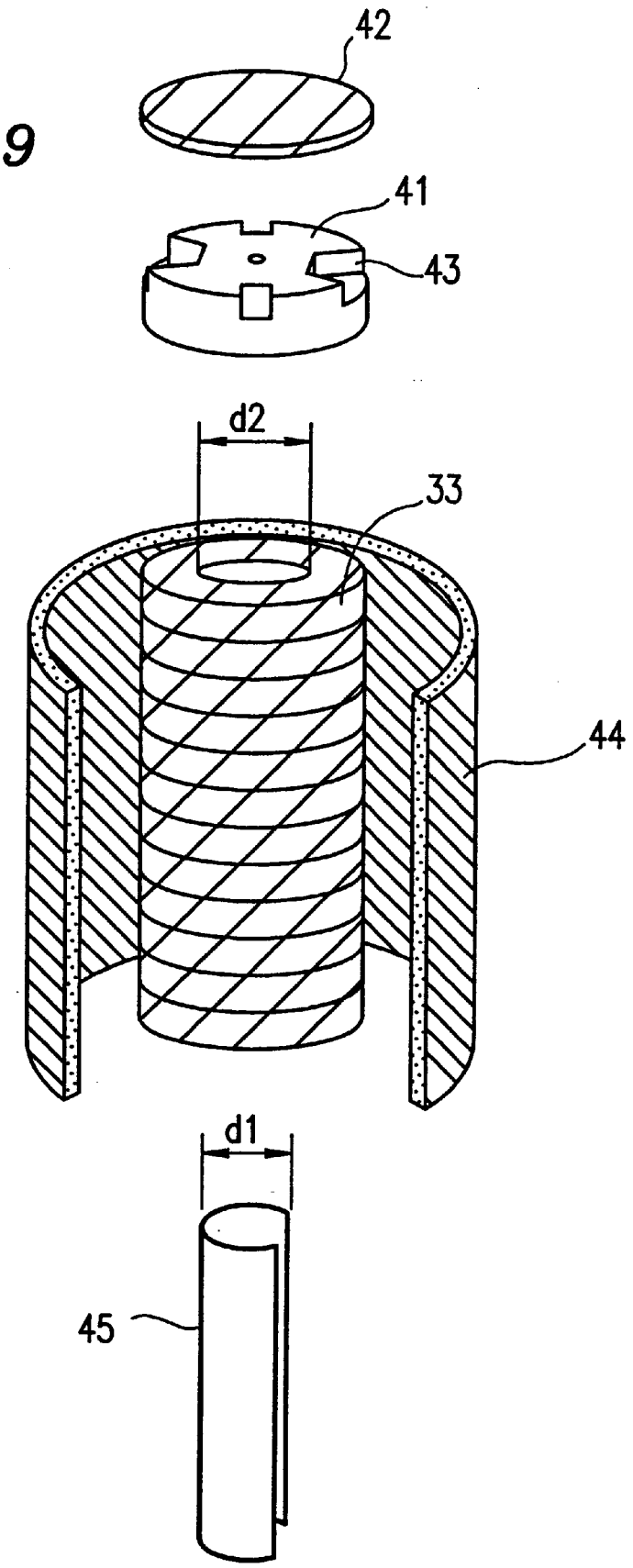
FIG. 9 is a view illustrating the structure of a boiler of the vapor generator.

FIG. 9 shows a structure of a heating generation section of the boiler 31. The metal body 33 is cylindrical. The metal body 33 has a disc-shaped unglazed chip 41 at a top end thereof. A ceramic paper sheet 42 is provided on the unglazed chip 41. The ceramic paper sheet 42 is heat-resistant and acts as an end surface diffusive member for diffusing the water in a horizontal direction. The unglazed chip 41 retains moisture satisfactorily but does not absorb water sufficiently quickly, whereas the ceramic paper sheet 42 does retain moisture satisfactorily and also absorbs water sufficiently quickly. The unglazed chip 41 has a liquid introduction groove 43 for efficiently introducing water which has been drip-fed and diffused into an outer peripheral surface of the metal body 33.

The metal body 33 is wrapped around by a ceramic cloth 44, which acts as an outer peripheral wall diffusive member for diffusing drip-fed water to the outer peripheral wall of the metal body 33. The ceramic cloth 44 is formed by processing ceramic long-fiber assembly into cloth. The use of the ceramic cloth 44 provides the advantages of improving the ability of retaining moisture and also raising the water absorption speed.

The water drip-fed from the top end of the boiler 31 is quickly absorbed into the ceramic paper sheet 42 and diffused into the entirety thereof, and then uniformly absorbed into the unglazed chip 41. Then, a part of the water flows down along the metal body 33 from the unglazed chip 41, whereas most of the water flows down along the ceramic cloth 44 provided around the metal body 33.

A shaft member 45 is inserted into the hollow space in the cylindrical metal body 33. The shaft member 45 prevents water drip-fed from the top end of the boiler 31 from flowing down the hollow space without being vaporized. The outer diameter d1 of the shaft member 45 is larger than the diameter d2 of the hollow space of the metal body 33 acting as a heat generator. The shaft member 45 is a rolled cylindrical member and has a sufficient spring expansion property to vary the outer diameter thereof. The shaft member 45 is kept in the hollow space in the metal body 33 by the extending force of the spring.

When the magnetic excitation coil 32 (FIG. 8) is excited, the metal body 33 is induced and thus quickly heated into a high temperature. As a result, the water drip-fed down the metal body 33 is heated while passing through the foam of the metal body 33 between the ceramic cloth 44 and the shaft member 45. The heated water is further heated while flowing downward and splashed from the downstream end of the metal body 33 or of a shaft member 45. After that, the water is sprayed as the vapor 10 from a vapor outlet 46 (FIG. 8) while in the state of being excessively heated.

Referring again to FIG. 8, the vapor 10 sprayed from the vapor outlet 46 is released into the heating chamber 3 upward from this lower position through a spraying outlet 47.

The vapor outlet 46 is attached so as to be opposed to the vapor spraying outlet 47 provided in a lower part of the left side wall of the heating chamber 3. The supporting plates 24*a* have a vapor direction guide 48 (also shown in FIG. 3) integrally formed in correspondence with the vapor spraying outlet 47. The vapor direction guide 48 has an upward outlet. Accordingly, the vapor 10 sprayed from the vapor outlet 46 is released upward to an upper part of the heating chamber 3 through the vapor direction guide 48.

Figure 10:
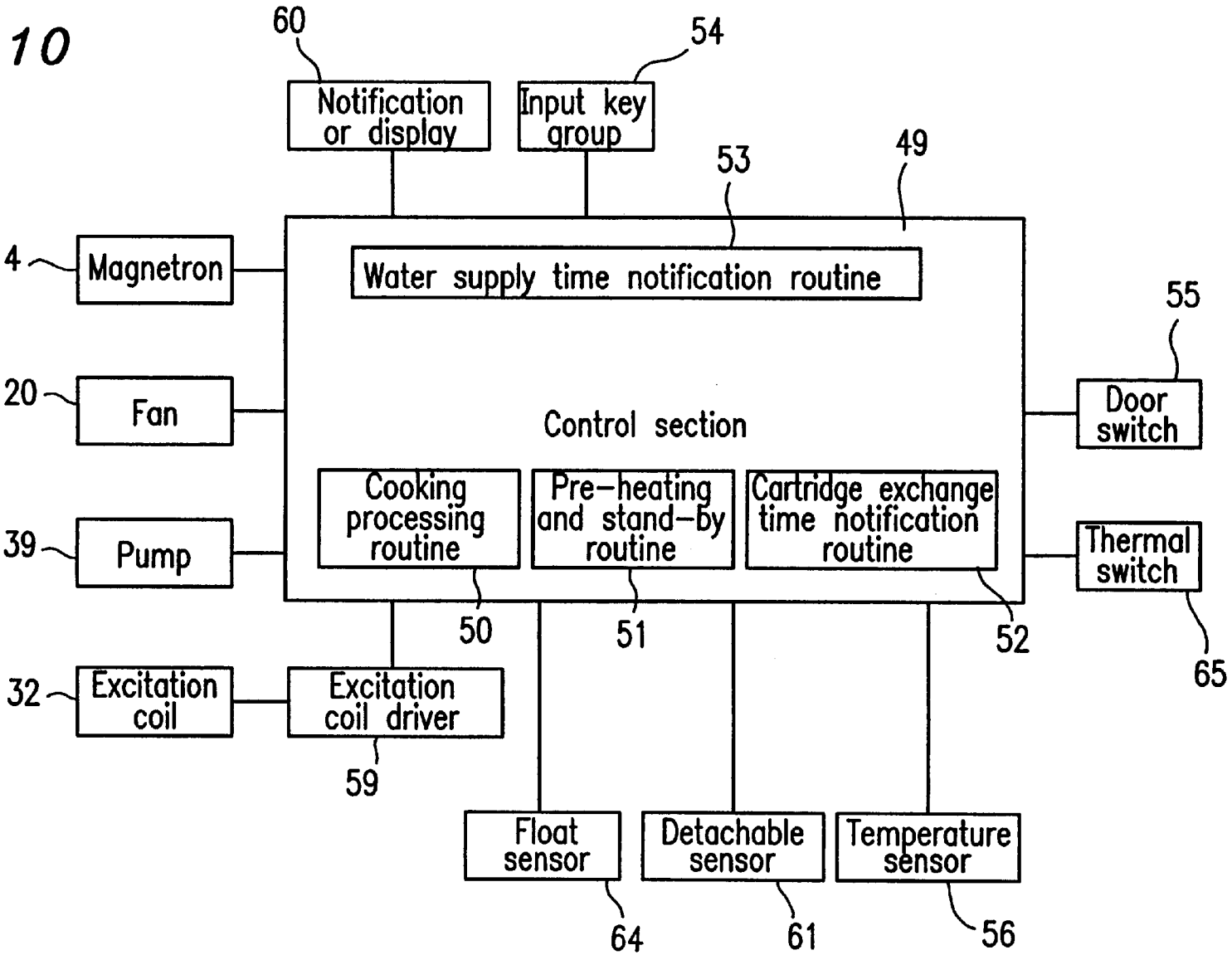
FIG. 10 shows a configuration of an electric circuit mounted in a main body of the microwave heating apparatus.

FIG. 10 shows a configuration of an electric circuit mounted in the main body 1.

A control section 49 controls the execution of various routines such as a cooking processing routine 50, a pre-heating and stand-by routine 51, a cartridge exchange time notification routine 52, and a water supply time notification routine 53. The control section 49 can also include a microcomputer.

After the item 2 is placed on the plate 27 (FIG. 3), the control section 49 can execute the cooking processing routine 50. Before the cooking processing routine 50 is executed, the control section 49 executes the pre-heating and stand-by routine 51. Thus, the heating chamber 3 is pre-heated.

Pre-heating and Stand-by Routine

Figure 11:
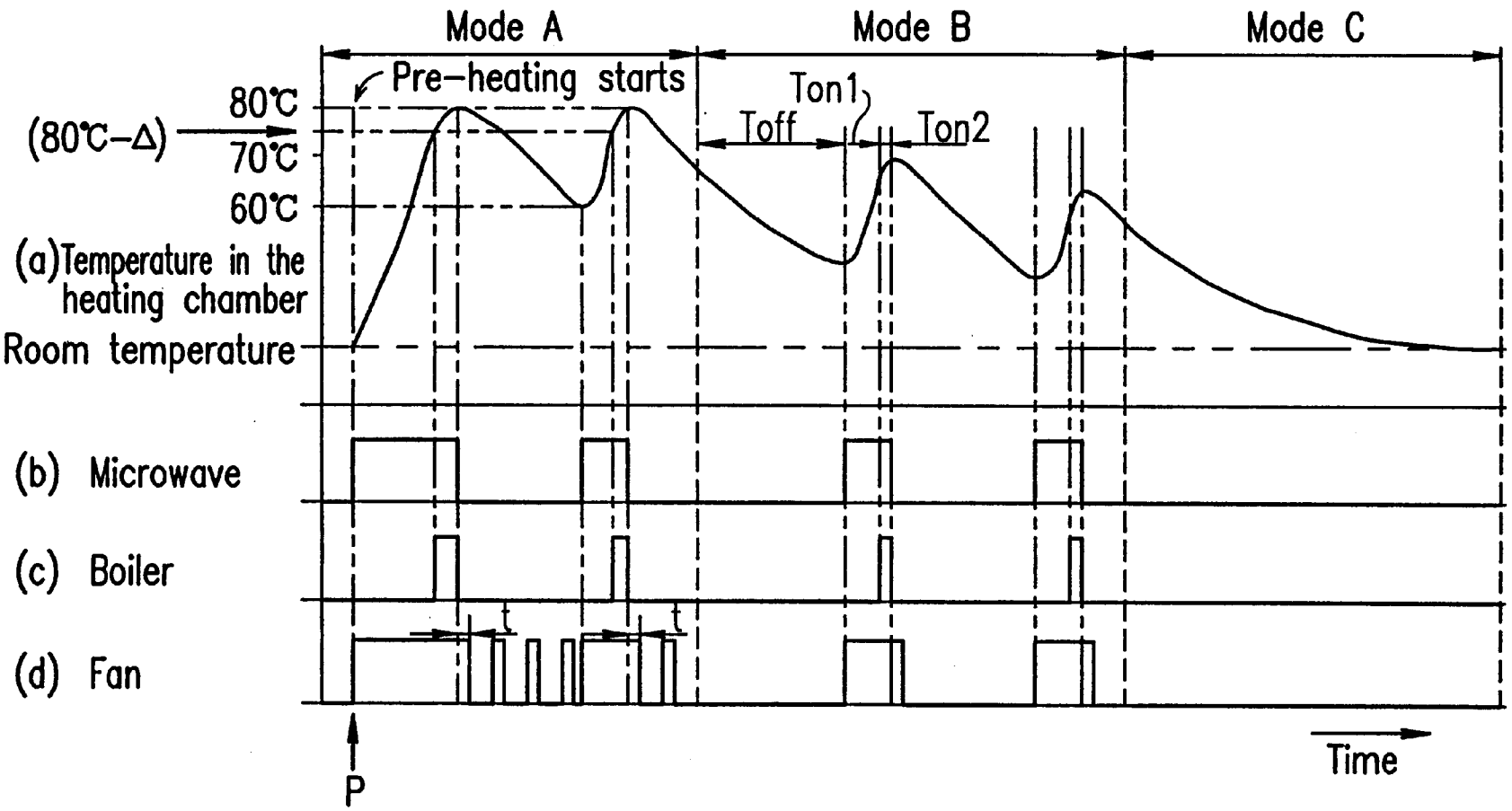
FIG. 11 is a timing diagram of a pre-heating and stand-by routine.

FIG. 11 shows the operation of the pre-heating and stand-by routine 51. The pre-heating and stand-by routine 51 is executed in a wait state.

When the control section 49 determines that the microwave heating apparatus is put into the wait state, the control section 49 detects when any key of an input key group 54 is operated, or automatically switches the mode of the pre-heating and stand-by routine 51 from mode A to mode B, and from mode B to mode C over time until it is detected by a signal from the door switch 55 that the first door 13 has been opened.

In an upper part of the heating chamber 3, a temperature sensor 56 is provided as shown in FIGS. 3 and 4. In mode A, the temperature in the heating chamber 3 is controlled so as to be 70±10° C. As shown in (b) and (d) in FIG. 11, the operation of the magnetron 4 and the fan 20 commences from the start P of pre-heating.

When the microwaves are radiated in the heating chamber 3, the entirety of each of the regenerating plates 28*a* and 28*b* generates heat. The supporting plates 24*a* and 24*b* formed of PPS (polyphenylene sulfide) also generate heat when irradiated by the microwaves although the temperature of the heat is lower than the heat generated by the regenerating plates 28*a* and 28*b*.

By operating the fan 20, a part of the warm air W (FIG. 3) which has become warm by cooling the magnetron 4 is released into the heating chamber 3 through the hole 57 (FIGS. 4 and 6) formed in the inner rear wall of the heating chamber 3. The released warm air Wa is sent to a front part of the heating chamber 3 while being guided, by a partition 21*d* provided on the top plate 21, between a top wall 3*b* and the top plate 21. From the front end of the top plate 21, the warm air Wa flows into a space where the plate 27 is set from the right through a gap S between a front end of the regenerating plate 28*a* and the first door 13.

The air in the space where the plate 27 is set is discharged outside through an outlet 58 (FIG. 4) formed in a left part of the top wall 3*b* of the heating chamber 3 as described below.

The outlet 58 is in communication with the regenerating plate 28*a* and the top plate 21 through a duct 21*e* (FIG. 5) formed on the top plate 21. Air Wb in the space where the plate 27 is set flows from the left side to between the regenerating plate 28*a* and the top plate 21 and is discharged outside through an outlet 58.

In this manner, the air in the heating chamber 3 is circulated by operating the fan 20. The operation of the magnetron 4 continues until the temperature detected by the temperature sensor 56 becomes 80° C. Portion (a) of FIG. 11 shows the temperature in the heating chamber 3. The operation of the fan 20 continues for a while even after the operation of the magnetron 4 is stopped in order to cool the components. Even while the magnetron 4 is in a pause, the fan 20 is operated regularly. Thus, the air in the heating chamber 3 is circulated. When the temperature detected by the temperature sensor 56 is reduced to 60° C., the control section 49 starts operating the magnetron 4. In this manner, the temperature in the heating chamber 3 is controlled to be 70±10° C.

Portion (c) of FIG. 11 shows the period in which the excitation coil 32 is driven. The excitation coil 32 is driven by an excitation coil driver 59 (FIG. 10) from when the temperature detected by the temperature sensor 56 becomes close to 80° C. (80° C.−Δ) until such a temperature becomes 80° C. Thus, the boiler 31 in the vapor generator 12 is pre-heated.

In the case where the microwave heating apparatus is still in the wait state even after the operation time period of mode A reaches a prescribed time period, the control section 49 executes the pre-heating and stand-by routine 51 in mode B for the purpose of saving energy. In mode B, the target temperature is set to be 60±10° C., which is lower than 70±10° C. A similar temperature control to the operation in mode A is executed.

In the case where the microwave heating apparatus is still in the wait state even after the operation time period of mode B reaches a prescribed time period, the control section 49 executes the pre-heating and stand-by routine 51 in mode C for the purpose of saving energy, and terminates the temperature control.

In either mode B or mode C, when the control section 49 detects that any key of the input key group 54 is operated, the pre-heating and stand-by routine 51 is immediately returned to mode A and performs pre-heating.

Cooking Processing Routine

In the cooking processing routine 50, based on the data input by the input key group 54, the operation pattern of the magnetron 4 and the operation pattern of the excitation coil driver 59 are selected. In accordance with the selected operation patterns, the microwaves 8 and the vapor 10 are generated. By use of the microwaves 8 and the vapor 10, the item 2 is properly cooked.

More specifically, for the cooking processing routine 50, one of the operation patterns shown in FIGS. 12 through 15 is selected.

Figure 12:
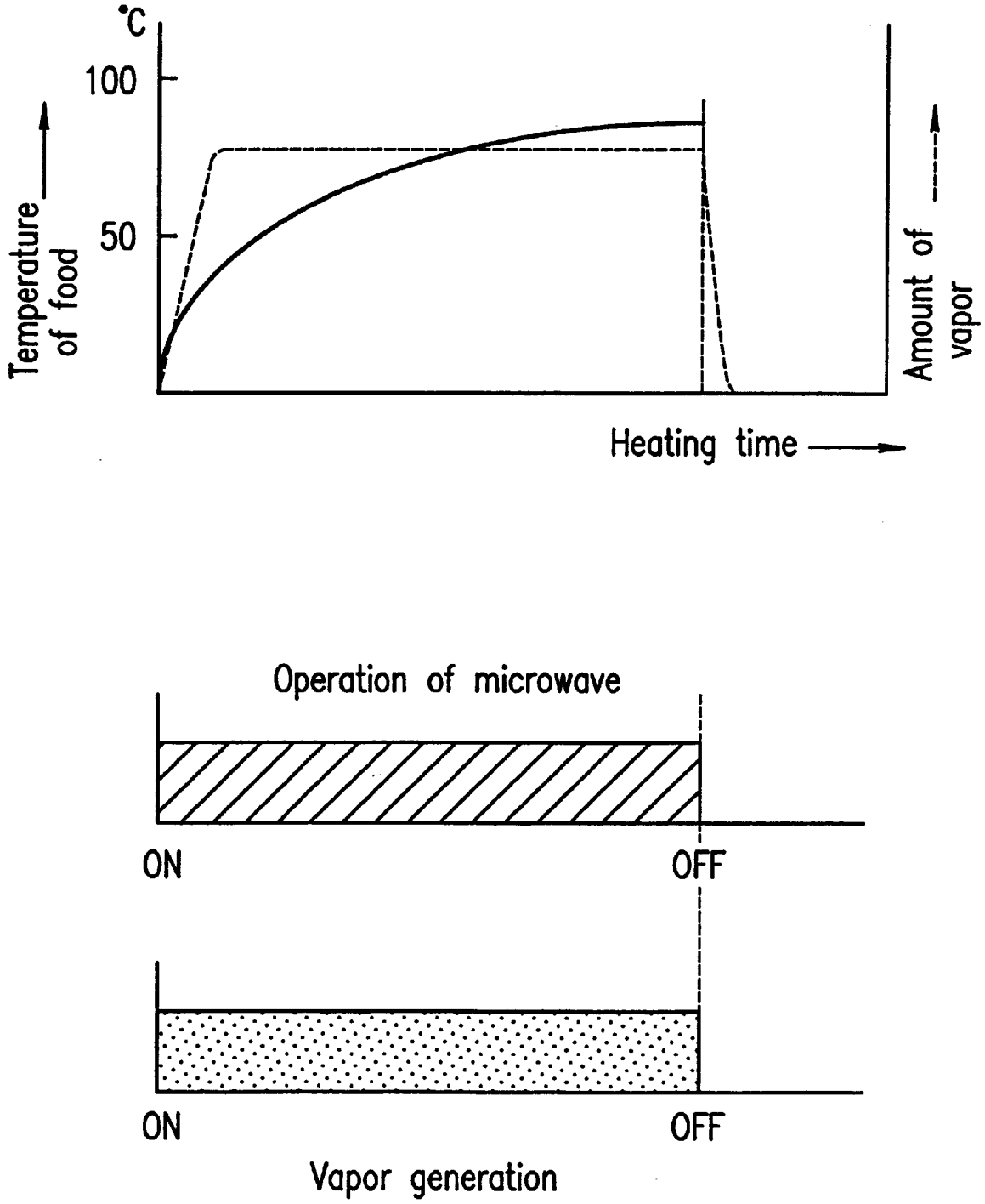
FIG. 12 shows an operational timing of a cooking processing routine.

In the operation pattern shown in FIG. 12, the rise of the vapor generation by the vapor generator 12 takes as short a time period as about 10 seconds. Accordingly, the vapor from the vapor generator 12 is supplied to the heating chamber 3 substantially simultaneously with the start of the operation of the microwaves. As a result, both of the microwaves 8 and the vapor 10 are substantially used during the entire time for heating for cooking. This restricts vaporization of the moisture in the food as the item 2 and realizes a more tender finish.

Before the cooking processing routine 50 is executed, the pre-heating and stand-by routine 51 is executed and thus the heating chamber 3 is warmed up inside. Accordingly, even if the vapor 10 supplied to the heating chamber 3 immediately after the execution of the cooking processing routine 50 is started, dew condensation does not form on the wall of the heating chamber 3.

Since there is no dew condensation, unnecessary electric wave absorption is not caused and also non-uniformity in the microwave distribution in the heating chamber 3 due to this dew condensation is avoided. As a result, a satisfactory heating state is obtained.

Moreover, the vapor 10 supplied to the heating chamber 3 is released into an upper part of the heating chamber 3 through the vapor direction guide 48 which is integrally formed on the supporting plate 24*a*. Thus, the vapor 10 is not in direct contact with the food. Accordingly, the temperature distribution in the heating chamber 3 is uniform, and heating is performed uniformly over the food.

Figure 13:
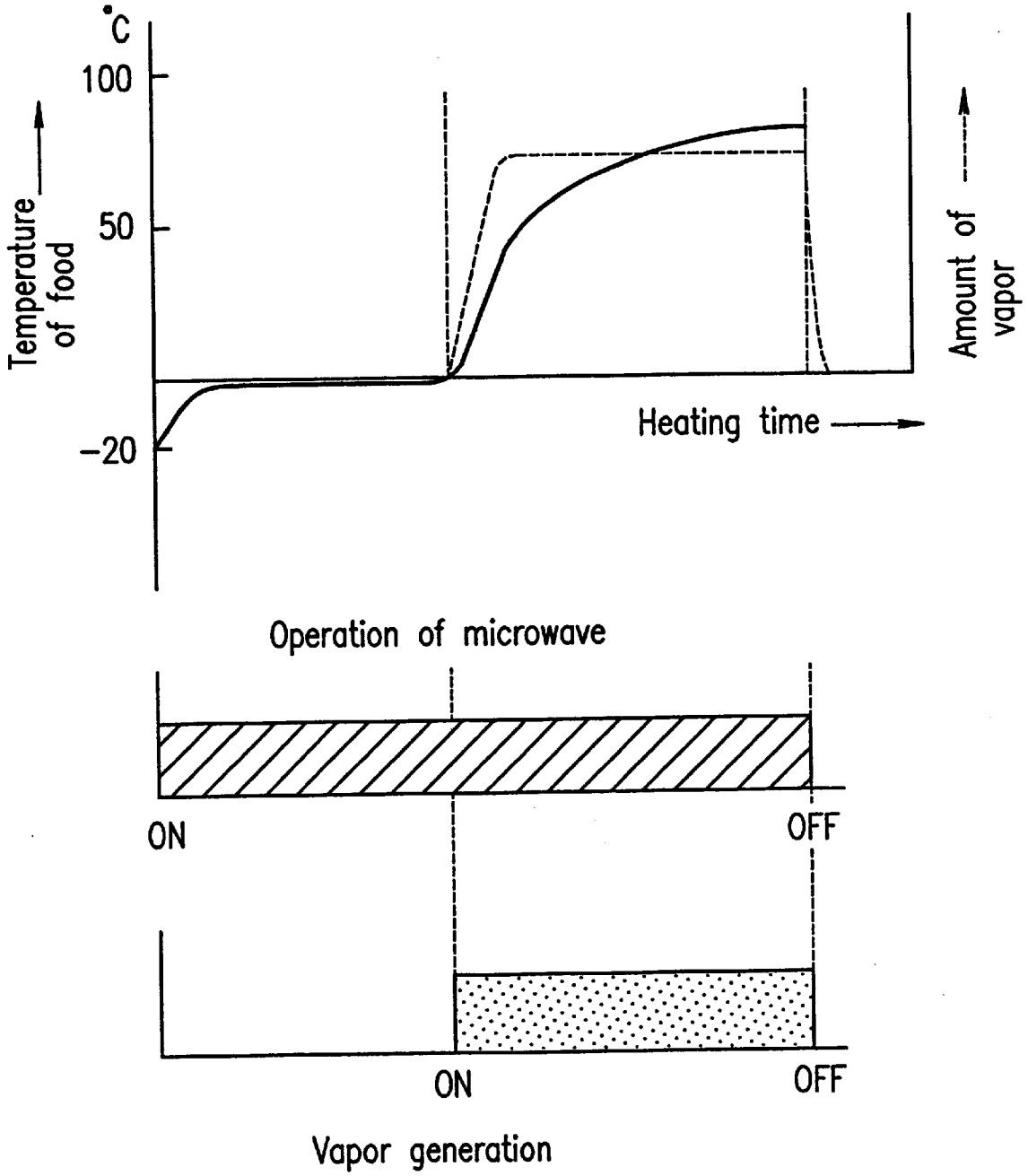
FIG. 13 shows another operational timing of a cooking processing routine.
Figure 14:
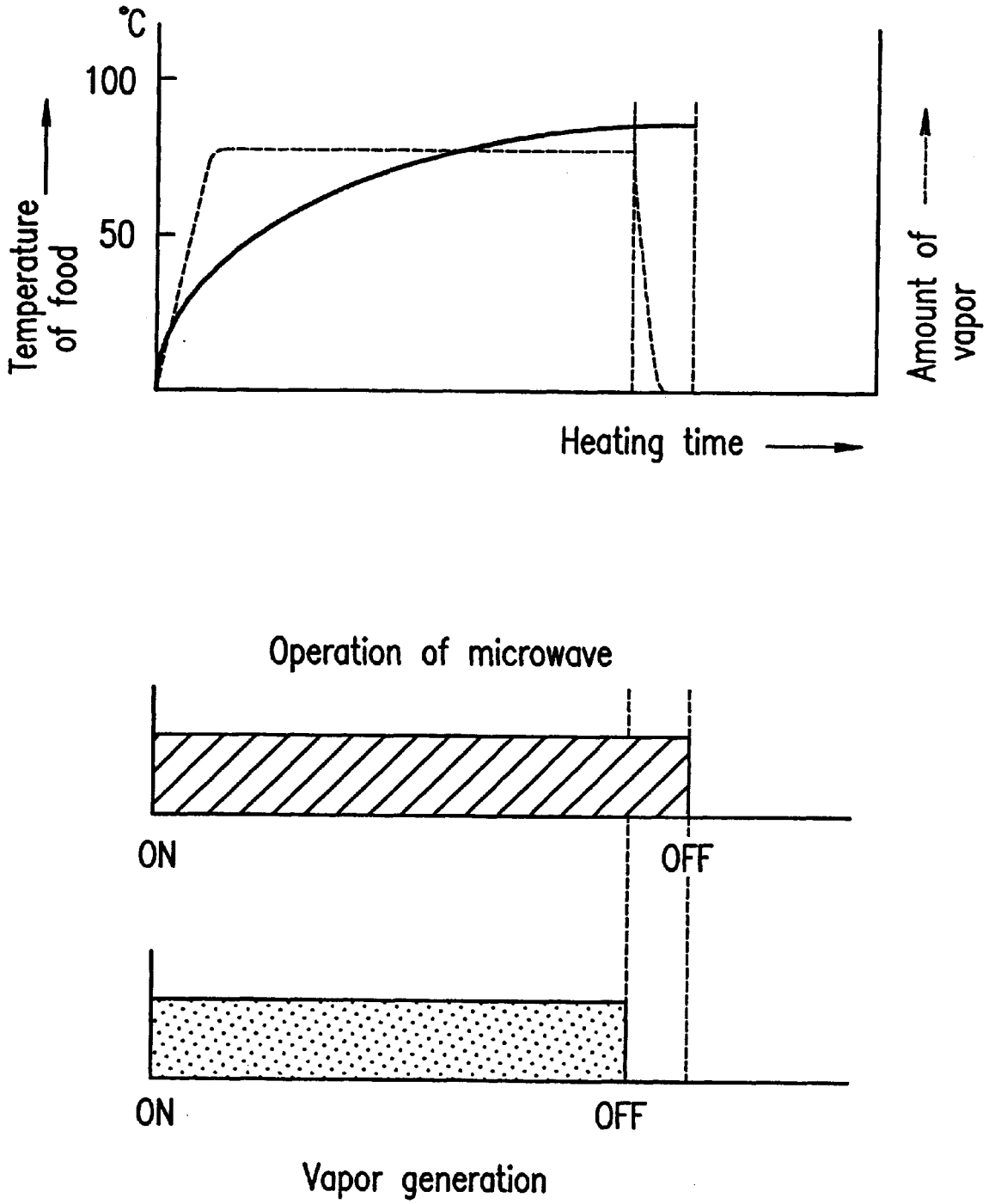
FIG. 14 shows still another operational timing of a cooking processing routine.
Figure 15:
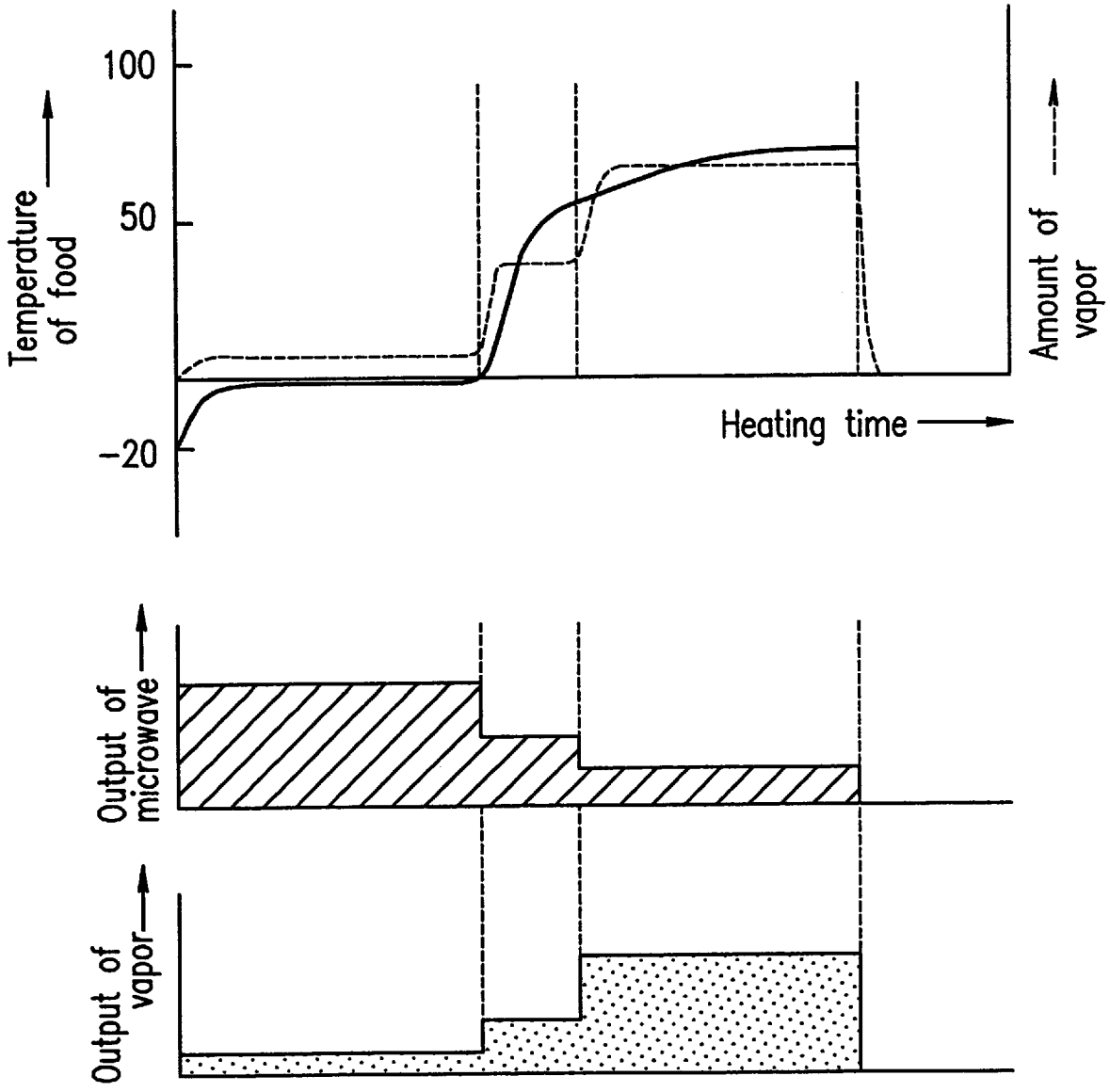
FIG. 15 shows yet another operational timing of a cooking processing routine.

Also in the other operation patterns shown in FIGS. 13 through 15, execution of the pre-heating and stand-by routine 51 before the cooking processing routine 50 avoids creation of dew condensation when the vapor 10 is supplied to the heating chamber 3.

The operation pattern shown in FIG. 13 is selected for heating and cooking frozen food. While the food is frozen, i.e., the temperature of the food is below 0° C., the food is heated only by the microwaves 8. Then, when the food is thawed and the temperature of the food rises above 0° C., the operation of the vapor generator 12 is started so as to perform heating for cooking by use of both the microwaves 8 and the vapor 10. The vaporization of the moisture from the food starts when the temperature of the food becomes above 0° C. However, such vaporization is restricted by cooking while wrapping the food with vapor, thereby realizing a more tender finish.

In the operation pattern shown in FIG. 14, the vapor 10 from the vapor generator 12 is supplied to the heating chamber 3 substantially simultaneously with the start of the operation of the microwaves, and the operation of the vapor generation is finished before the operation of the microwaves finishes. In such a case, the amount of vapor 10 in the heating chamber 3 is reduced at the end of cooking. Thus, the food is easily taken out without the user coming into contact with the high-temperature vapor.

The operation pattern shown in FIG. 15 is another pattern which is selected for heating frozen food for cooking. While the food is frozen, the food is heated for cooking by use of high-output microwaves 8 and low-output vapor 10 from the vapor generator 12. Then, when the food is thawed and the temperature of the food becomes above 0° C., the output of the microwaves 8 is decreased to a middle level and the output of the vapor 10 is increased to a middle level. When the temperature of the food is raised to a middle level, the output of the microwaves 8 is decreased to a low level and the output of the vapor 10 is increased to a high level.

In such a case, the food can be heated uniformly while vaporization of the moisture is restricted. Thus, a more tender finish is realized.

Cartridge Exchange Time Notification Routine

Figure 16:
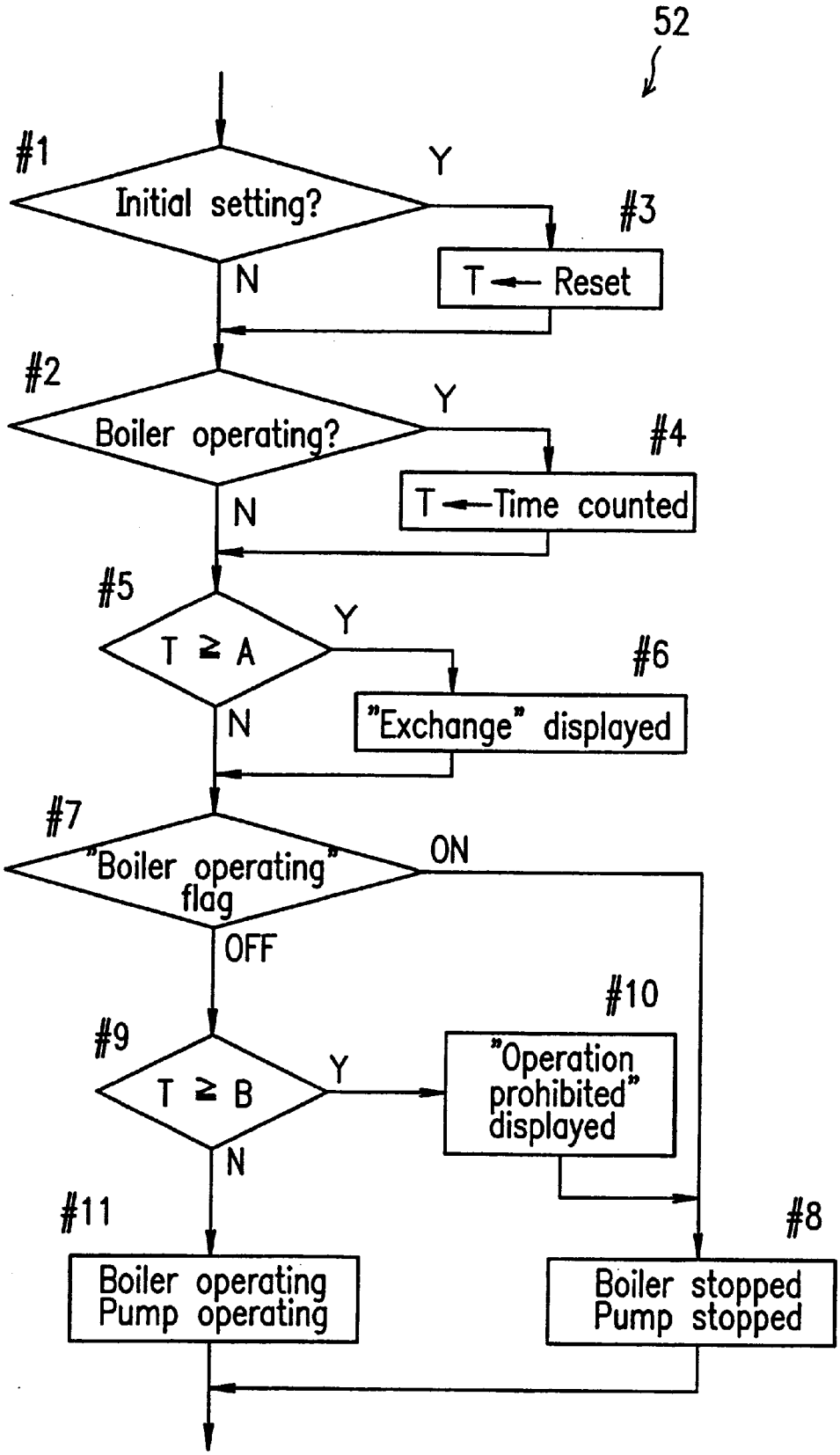
FIG. 16 is a flowchart of a cartridge exchange time notification routine.

FIG. 16 shows the steps of the cartridge exchange time notification routine 52. The control section 49 is structured to control the operation time of the pump 39 in accordance with the cartridge exchange time notification routine 52 and to notify the exchange time of the water processing material. To use the cartridge exchange time notification routine 52, set time A for exchange notification and set time B for prohibiting the operation (B≧A) are set in advance.

In #1, it is checked whether the set time A and B are to be initially set or not. If no initial setting is to be performed, #2 is executed. If initial setting is performed in #1, #2 is executed after the content (T) in the register is reset.

In #2, it is checked whether the pump 39 is operating or not. If it is determined that the pump 39 is operating in #2, the operation time of the pump 39 is counted in #4 by the register which was reset in #3. Then, #5 is executed. If it is determined that the pump 39 is not operating in #2, #5 is executed without executing #4.

In #5, the content (T) in the register which counted the operation time of the pump 39 in #4 and the set time A for exchange notification are compared. If it is determined that T≧A in #5, an instruction for water processing material exchange is displayed on a display 60 (FIG. 1) of an operation panel in #6. If it is determined that T<A in #5, #7 is executed.

In #7, it is checked whether a flag for instructing the operation of the vapor generator 12 is set or not. If it is determined that the flag for instructing the operation of the vapor generator 12 is not set in #7, the operation of the pump 39 and the vapor generator 12 is stopped in #8. If it is determined that the flag for instructing the operation of the vapor generator 12 is set in #7, the content (T) of the register which counted the operation time of the pump 39 in #4 and the set time B are compared in #9. If it is determined that T≧B in #9, an instruction for prohibiting the operation of the vapor generator 12 is displayed on the display 60 of the operation panel in #10. Then, #8 is executed. If it is determined that T<B in #9, #11 is executed. In #11, the operation of the pump 39 and the vapor generator 12 is performed.

The set time A is keyed in by the input key group 54 in accordance with the water quality at the site of installment when the microwave heating apparatus is installed. Specifically, the water quality of the site in use is measured by a water hardness reagent and the water hardness measurement is keyed-in by the input key groups 54. More specifically, when the water hardness obtained by the measurement using the water hardness reagent is one of 50, 100 or 200, switching into the operation information key-in mode is performed and then the water hardness obtained by the measurement is keyed-in. In this example, while the first door 13 is opened, a specific key (for example, a cooking start switch) of the input key group 54 is kept pressed. In this state, a specific code is keyed-in, thereby switching the control section 49 into the operation information key-in mode. In the case where the water hardness obtained by the measurement is 50, "5" and "0" are keyed-in. In this case, the control section 49 sets the count value corresponding to the operation time of the pump 39 which is required to supply 600 liters of water as the set time A, and executes the cartridge exchange time notification routine 52.

In the case where the water hardness obtained by the measurement is 100, the control section 49 sets the count value corresponding to the operation time of the pump 39 which is required to supply 300 liters of water as the set time A, and executes the cartridge exchange time notification routine 52.

In the case where the water hardness obtained by the measurement is 200, the control section 49 sets the count value corresponding to the operation time of the pump 39 which is required to supply 150 liters of water as the set time A, and executes the cartridge exchange time notification routine 52.

Safety Routine

As shown in FIG. 8, the main body 1 includes a detachable sensor 61 for detecting that the water supply tank 15 is properly set, and a water level detector 62 for detecting the water level in the water supply tank 15. The water level detector 62 includes a magnetic float 63 incorporated into the water supply tank 15 and a float sensor 64 incorporated into the bottom plate 34 for detecting the position of the magnet float 63.

Figure 17:
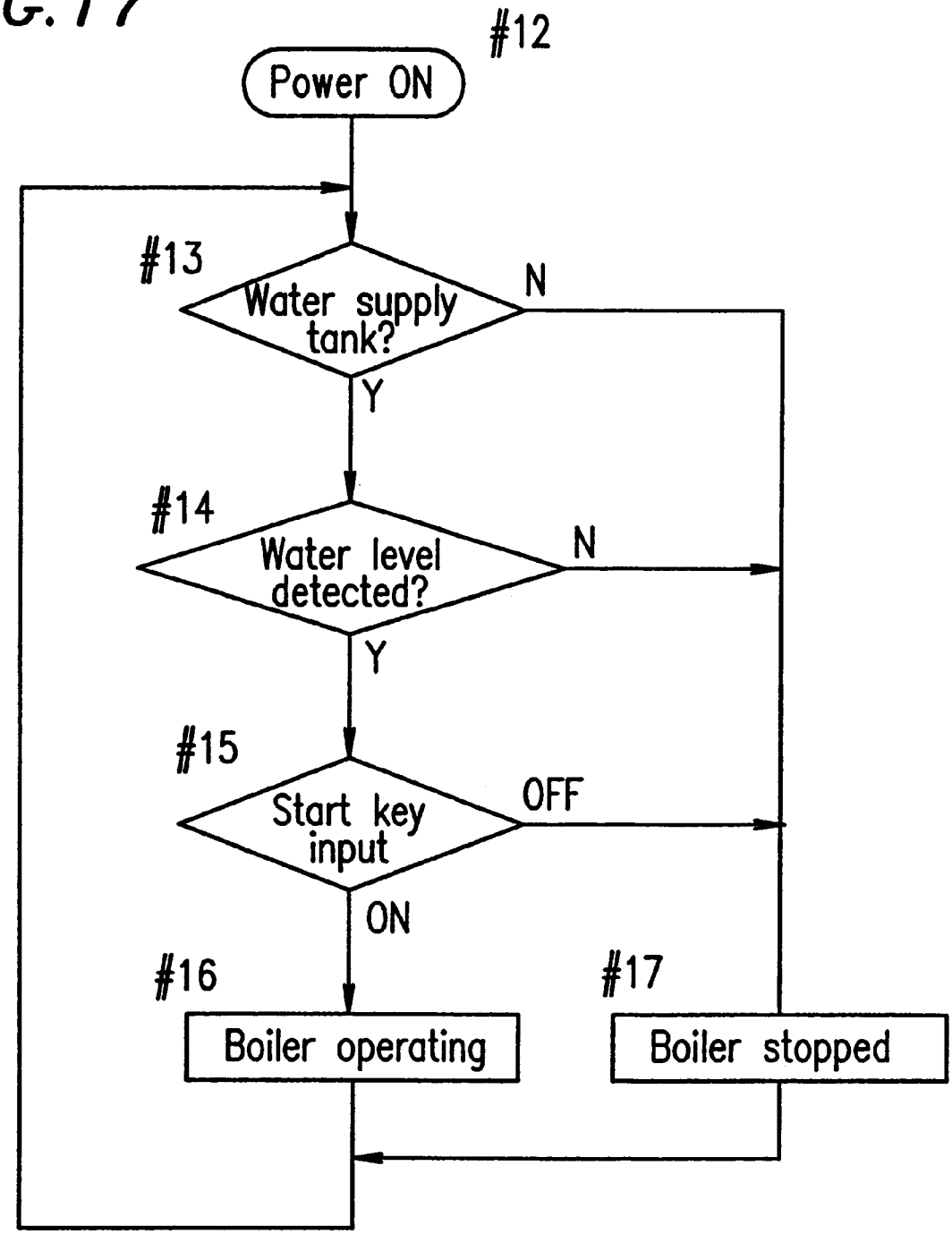
FIG. 17 is a flowchart of a safety routine.
Figure 18:
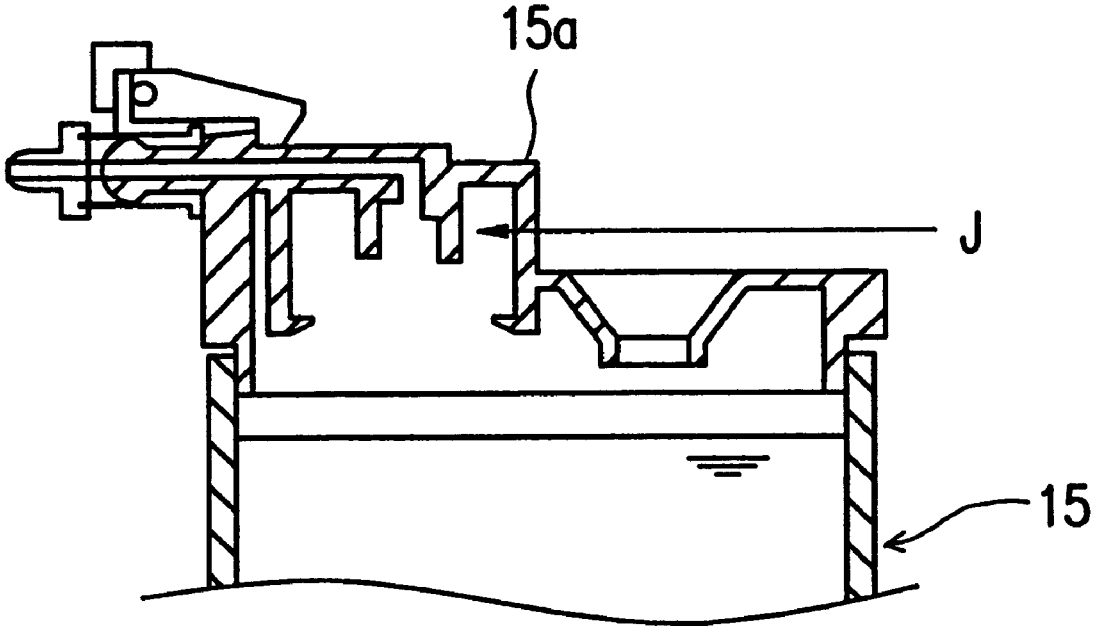
FIG. 18 is a view illustrating the state where a water processing material cartridge is not mounted.

As shown in FIG. 17, when the control section 49 detects the power has been turned on in #12, the control section 49 checks the detachable sensor 61 in #13 and checks the float sensor 64 in #14. Then, the control sensor 49 checks whether the start key in the input key group 54 has been operated or not in #15.

Accordingly, only when the water supply tank 15 is properly set in the main body land water in at least a minimum possible amount remains, the operation of the vapor generator 12 starts in response to the input by the start key (#15, #16). If the water supply tank 15 is not properly set in the main body 1 or the water level is not sufficiently high, the operation of the vapor generator 12 is stopped in #17. Thus, safe operation of the vapor generator 12 is guaranteed.

The water processing material cartridge 40 is inserted from below into a corresponding part of a lid 15*a* of the water supply tank 15 and pivoted by a prescribed angle for locking, thereby being attached to the water supply tank 15. Such an attachment makes it easier to exchange the water processing material cartridge 40. The water supply tank 15 is structured so that a connection position J (FIG. 8) between the lid 15*a* and the water processing material cartridge 40 is above the highest water level of the water supply tank 15. Accordingly, when the water supply tank 15 is operated without mounting the water processing material cartridge 40, water is not supplied to the vapor genera 12 even if the pump 39 is operated. Thus, the water containing a scale component is avoided from being erroneously supplied to the metal body 33, and thus from clogging the metal body 33.

In the state where the water processing material cartridge 40 is not mounted, water is not supplied to the metal body 33 even if the pump 39 is operated. This raises the temperature of the metal body 33 abnormally. In this example, the control section 49 monitors the temperature of the metal body 33 using a thermal switch 65 so that the operation of the excitation coil driver 59 is stopped when such an abnormal temperature rise is detected.

When the water drip-fed on the metal body 33 is not completely vaporized, a water puddle is generated in the vicinity of the vapor outlet 46 of the vapor generator 12. In this example, as shown in FIG. 8, the lower level of the vapor outlet 46 is set to be lower than the level K (FIG. 8) of the vapor spraying outlet 47 in the heating chamber 3. Accordingly, even if a water puddle is generated in the vicinity of the vapor outlet 46, such water does not flow into the heating chamber 3 through the water spraying outlet 47.

The water puddle generated in the vicinity of the water outlet 46 flows down to a waste water tank 67 from a discharge outlet 46*a* through a trap 66. The waste water generated in the heating chamber 3 is received by a conduit 68 and flows into the waste water tank 67.

Figure 19:
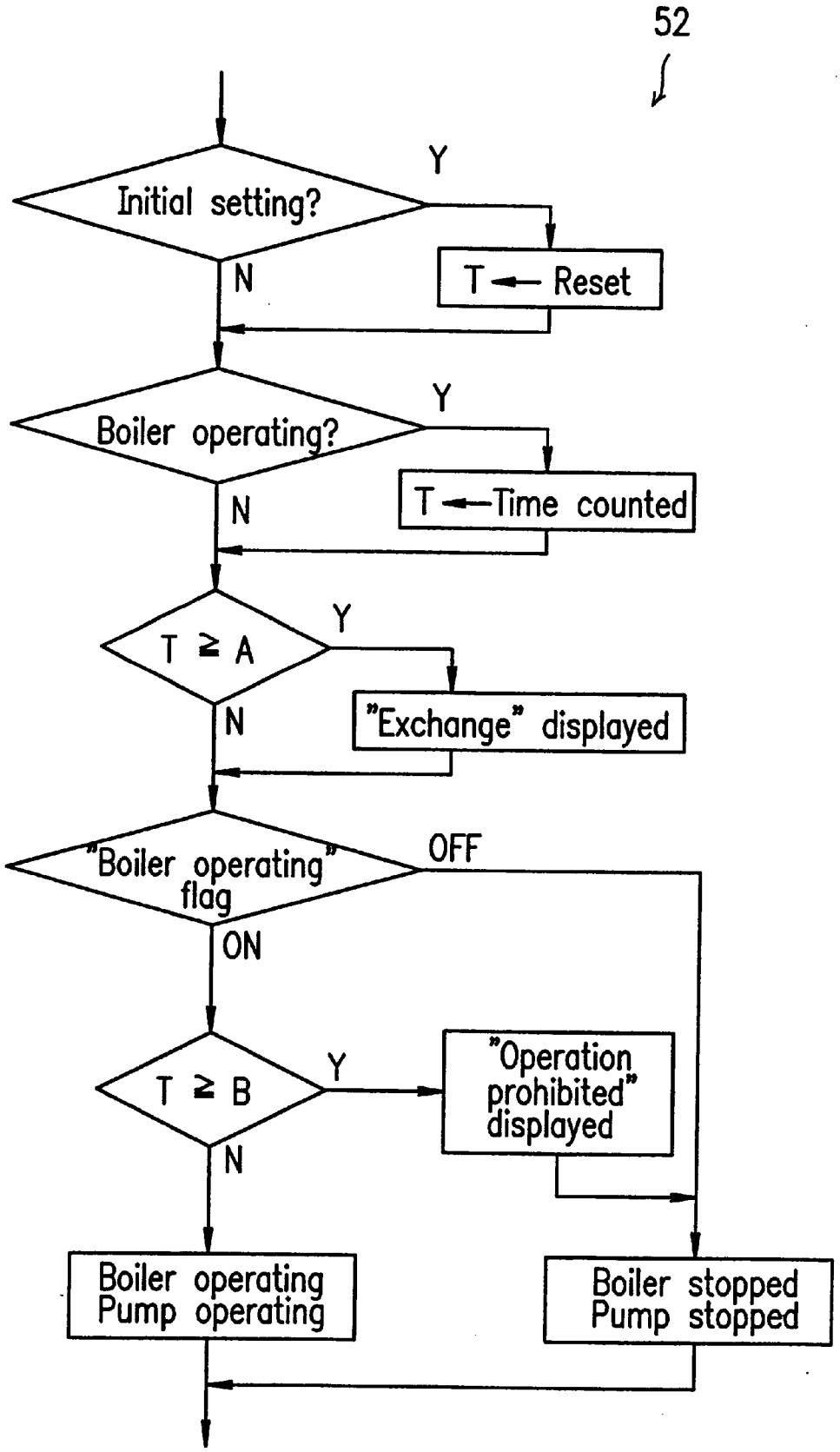
FIG. 19 is a flowchart of another cartridge exchange time notification routine.
Figure 20:
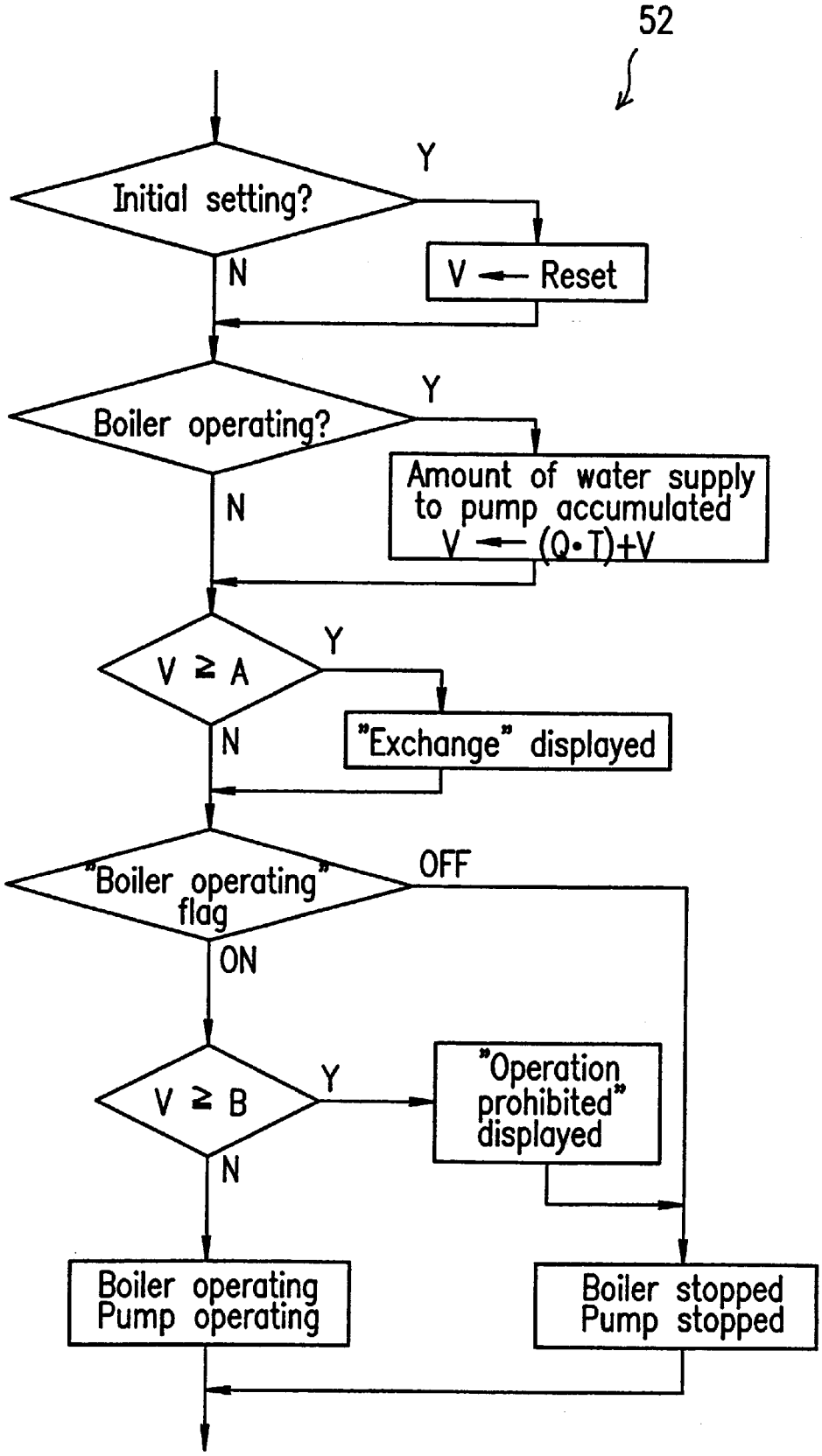
FIG. 20 a flowchart of still another cartridge exchange time notification routine.

In this example, the time for exchanging the water processing material cartridge 40 to be notified is determined based on the operation time of the pump 39. Alternatively, such time can be determined based on the operation time of the vapor generator 12 as shown in FIG. 19 or based on the water amount supplied by the pump 39 as shown in FIG. 20. In FIG. 20, letter V represents the result of accumulation of the water amount supplied by the pump, letter Q represents the flow rate of the pump which is set per unit time, and letter T represents the sampling time interval.

In the above examples, upon the detection that the water processing material cartridge 40 has reached the exchange time, the boiler 31 and the pump 39 are stopped. In the example shown in FIG. 16, a water processing material cartridge 40 is exchanged with a new one, and the same register content which was reset in #3 is reset and the routine returns to #1. At this point, the operation resumes for the first time after the exchange. Alternatively, the control section 49 can be structured to stop the operation upon the detection that the water processing material cartridge 40 has reached the exchange time and to detect the input operation for re-start and allow the operation only for a prescribed time period. By such a system, the user can use the microwave heating apparatus even while a new water processing material cartridge 40 is being prepared. It is expected that the work efficiency is improved by such a system. This can also be applied to the case where the time for exchanging the water processing material cartridge 40 is determined based on the operation of the boiler 31 or the water amount supplied by the pump.

In the above-described example, two regenerating plates 28*a* and 28*b* are used. A regenerating plate can be provided on at least one surface of the top, bottom, left, right and inner rear walls of the heating chamber 3. Such an arrangement of the regenerating plate is effective for restricting the creation of dew condensation when the vapor 10 is supplied into the heating chamber 3.

Water Supply Notification Routine

Figure 21:
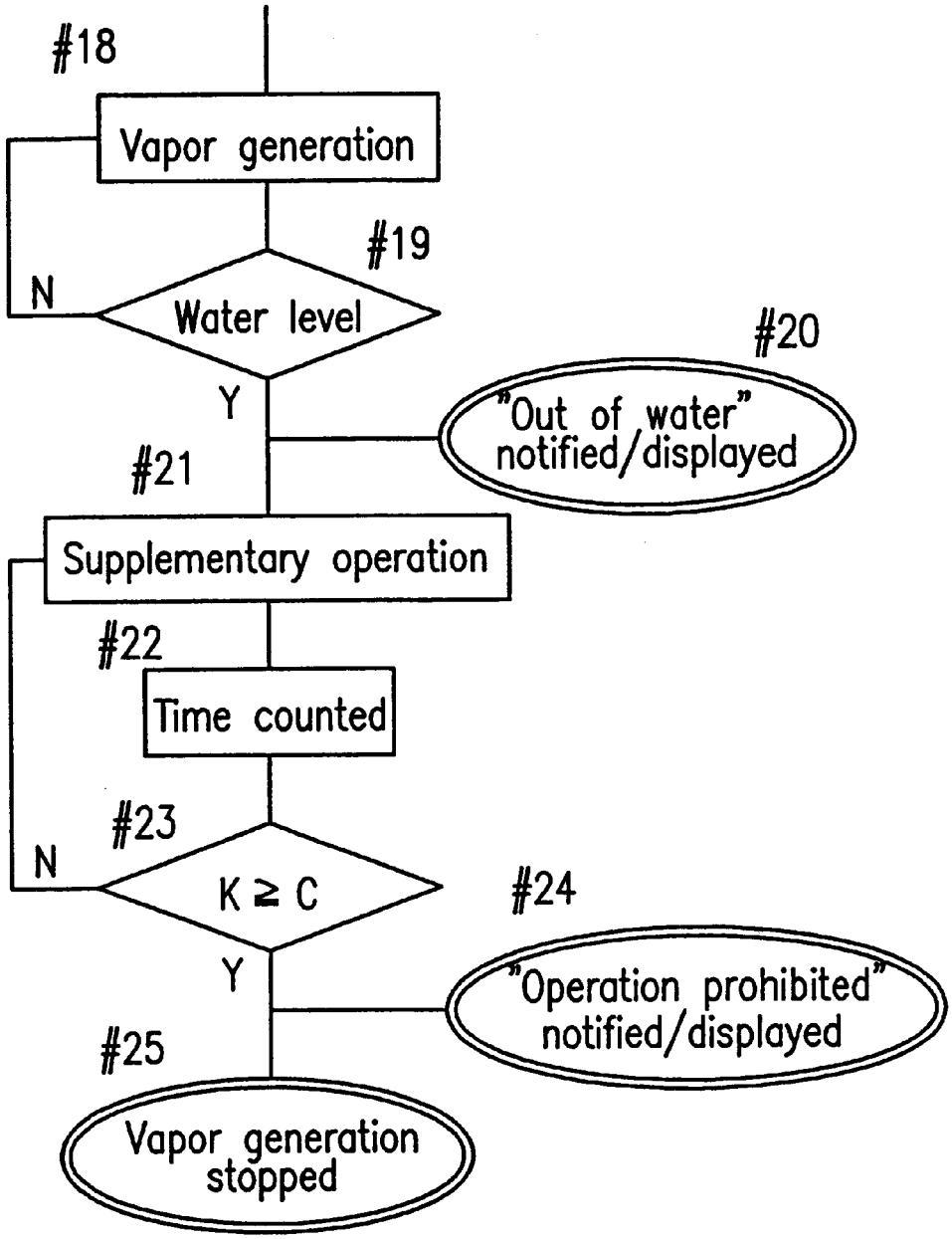
FIG. 21 is a flowchart of a water supply time notification routine.
Figure 22:
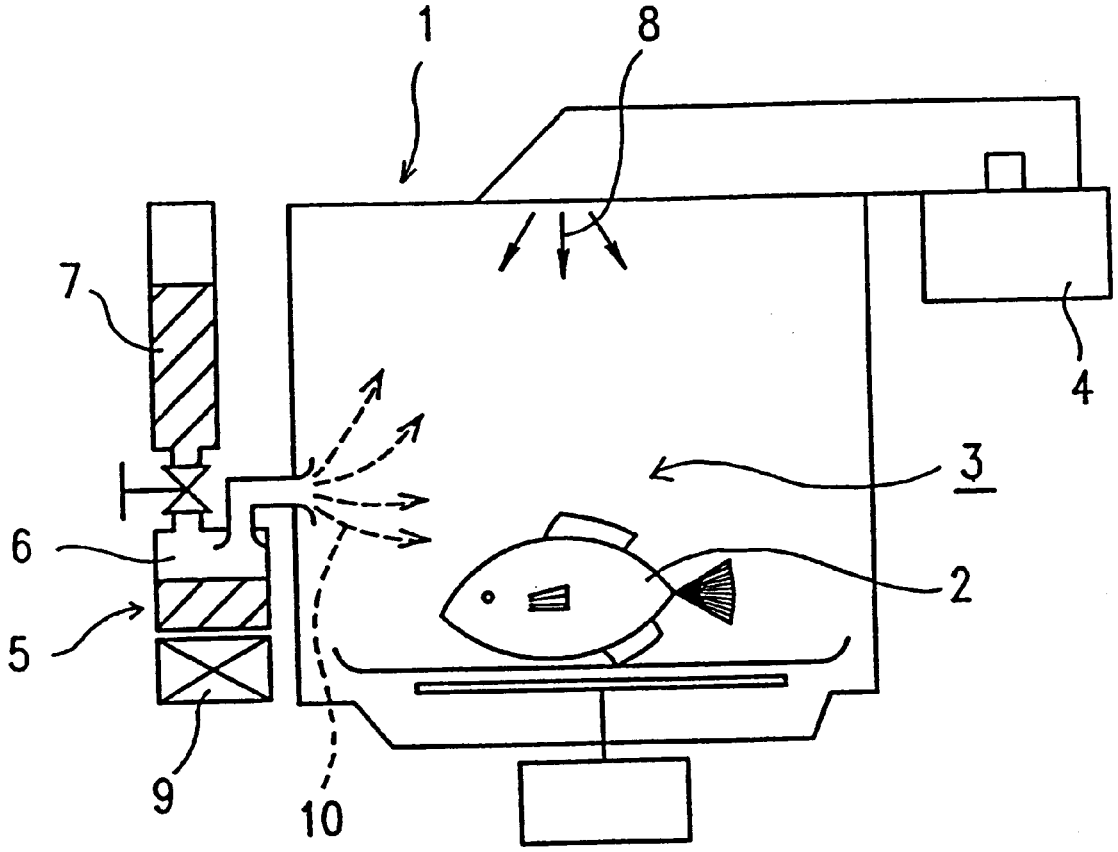
FIG. 22 (prior art)
FIG. 22 is a view illustrating a structure of a conventional microwave heating apparatus.
Figure 23:
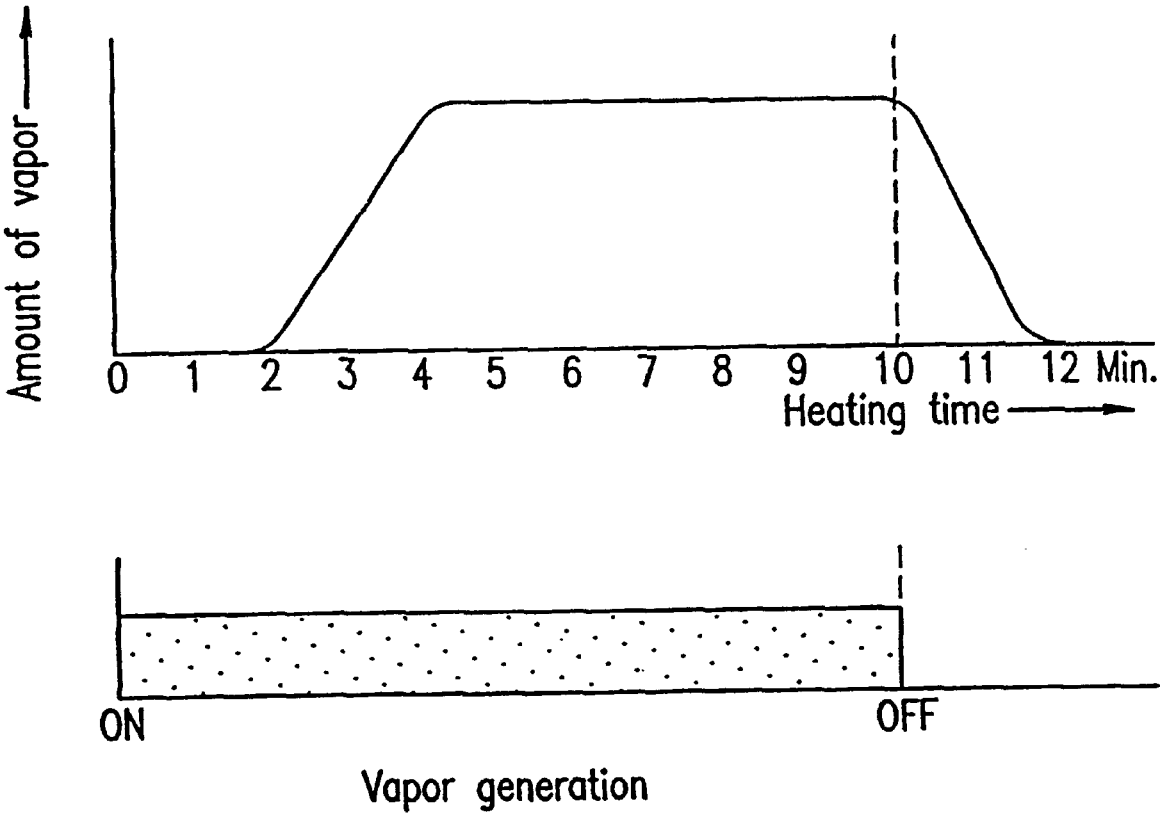
FIG. 23 (prior art)
FIG. 23 is a timing diagram of cooking processing of the conventional microwave heating apparatus.

As shown in FIG. 21, the water supply notification is controlled based on the exchange notification based on a detection signal from the float sensor 64 and also on set time C for prohibiting the operation of the vapor generator 12. The water level detected by the float sensor 64 is above the inlet of the water processing material cartridge 40, and thus water supply to the vapor generator 12 is possible even after the float sensor 64 operates. The float sensor 64 includes a float having a buried magnet mounted in the water supply tank 15 and a lead switch provided at a position separated from the water supply tank 15.

When the water supply tank 15 is properly mounted, the vapor generator 12 is properly operated in #18. The control section 49 checks the float sensor 64 in #19. If a water level is not detected in #19, the operation of the vapor generator 12 in #18 is continued. If a water level is detected in #19, the water supply notification is displayed on the display 60 of the operation panel #20 and also supplementary operation is performed in #21. In #22, the operation time is counted. In #23, the content (K) in the counting register and the supplementary operation time C are compared. If it is determined that $K \geqq C$ in #23, instructions for supplying water to the water supply tank 15 and for prohibiting the operation of the vapor generator 12 are displayed on the display 60 of the operation panel in #24. Then, the operation of the vapor generator 12 is stopped in #25. If it is determined that K<C in #23, the supplementary operation is allowed in #21, and the operation time is accumulated in #22.

As described above, by providing supplementary operation time and allowing the vapor generation to continue even after the water supply notification, the vapor generator is prevented from stopping when the vapor is used for cooking. Thus, cooking can be continued even during water supply.

The same effects can be obtained by setting the supplementary operation time by comparing the signal from the water level detector to the notified water level and the water level at which the operation is prohibited.

INDUSTRIAL APPLICABILITY

In a microwave heating apparatus according to claim 1, the heating chamber includes a regenerating plate for generating and regenerating heat when radiated by the microwaves from the microwave generator. By supplying the vapor to the heating chamber in the state where the regenerating plate is heated, dew condensation can be reduced.

In a microwave heating apparatus according to claim 2, the vapor generator includes an excitation coil provided outside a vapor generating chamber and a metal body provided inside the vapor generating chamber which is formed of one of foam and fiber, and water from a water supply tank is drip-fed on a top end of the metal body. Thus, dew condensation can be reduced, and the vapor can be supplied to the heat chamber. Thus, the time required for cooking can be shortened.

In a microwave heating apparatus according to claim 3 or 4, the regenerating plate is provided at a specified position. Such an arrangement of the regenerating plate enables efficient heating of the regenerating plate by microwaves radiated to the heating chamber. This is effective in preventing dew condensation when the vapor is supplied into the heating chamber.

In a microwave heating apparatus according to claim 5, a control section is provided for pre-heating the regenerating plate to a prescribed temperature by operat the microwave generator prior to the supply of the vapor to the heating chamber from the vapor generator. By such pre-heating, the regenerating plate is heated to a prescribed temperature at the time when the vapor is supplied to the heating chamber. As a result, generation of dew condensation when the vapor is supplied to the heating chamber is prevented certainly.

In a microwave heating apparatus according to claim 6, a vapor spraying outlet is provided for releasing the vapor upward from a lower position in the heating chamber. The vapor supplied to the heating chamber is blown into an upper position of the heating chamber and then moves into a lower position of the heating chamber at which the item to be heated is set. Since the vapor does not get into direct contact with the item to be heated, the item can be heated uniformly for cooking.

In a microwave heating apparatus according to claim 7, a supporting plate is provided for covering a side wall of the heating chamber and supporting ends of the regenerating plate, and the regenerating plate has a vapor direction guide formed thereon for releasing the vapor upward to a position corresponding to a vapor spraying outlet formed at a lower position of the side wall of the heating chamber. The vapor supplied to the heating chamber is blown into an upper position of the heating chamber and then moves into a lower position of the heating chamber where the item to be heated is set. Since the vapor does not get into direct contact with the item to be heated, the item can be heated uniformly for cooking.

In a microwave heating apparatus according to claim 8, a length of the regenerating plate in a depth direction is shorter than a length of the heating chamber in the depth direction, and the heating chamber is structured so that air warmed by cooling a magnetron (oscillation tube) of a microwave generator flows in through a gap between at least one of the walls of the heating chamber and the regenerating plate which is set in the heating chamber. By such a structure, warm air is supplied into the heating chamber so that the air in the heating chamber supplied with the vapor is circulated, without providing a special heating apparatus for heating air. This is effective in restricting the generation of dew condensation and making the temperature in the heating chamber uniform.

In a microwave heating apparatus according to claim 9, a vapor spraying outlet formed at the lower position on a side wall of the heating chamber is connected to an outlet of a boiler of the vapor generator, and a lower level of the vapor spraying outlet is lower than a lower level of the outlet of the boiler. Thus, water flowing down without becoming vapor is prevented from being flowing into the heating chamber.

In a microwave heating apparatus according to claim 10, the regenerating plate efficiently regenerates the heat generated by radiation of the microwaves. Thus, the surface of the regenerating plate can be pre-heated to a uniform temperature. This is effective in restricting the generation of dew condensation when the vapor is supplied to the heating chamber.

In a microwave heating apparatus according to claim 11, the control section pre-heats the heating chamber to a first target temperature under a certain condition and pre-heats the heating chamber to a second target temperature under another condition. By switching the target temperature, energy-saving operation can be realized without spoiling the functions of the microwave heating apparatus.

In a microwave heating apparatus according to claim 12, the water drip-fed from the water supply tank reaches the metal body while being uniformly diffused by a diffusive member. By this, the heating efficiency of the metal body is improved and liquid is prevented from flowing down without being vaporized. Since the temperature of the heat generating body is reduced, the deterioration of the heat generating body by the heat is restricted, thus improving the durability thereof.

In a microwave heating apparatus according to claim 13, the water drip-fed from the water supply tank reaches the metal body while being uniformly diffused by an outer peripheral wall diffusive member. Diffused water is heated on the outer peripheral wall where the heating temperature is the highest. As a result, the heating efficiency is raised and heating speed is increased.

In a microwave heating apparatus according to claim 14, the outer peripheral wall diffusive member is formed of long-fiber assembly. The water which has reached the top end of the outer peripheral wall diffusive member flows down uniformly. Moreover, since the long-fiber assembly retains the liquid in the gap among the fibers, the liquid supplied to the heat generating body is prevented from flowing down without being vaporized. By processing the long-fiber assembly into a cloth, the capillary function and the ability of retaining the moisture are improved, and fiber disturbance is reduced. Thus, the attachment of the outer peripheral wall diffusive material to the heat generating body becomes easy.

In a microwave heating apparatus according to claim 15, water passes through the cylinder passage defined by the inner wall of the metal body and the shaft member. Accordingly, the heating efficiency can be improved. Since the heated vapor is diffused at a high speed in the heat generating body so as to heat the liquid which has not been vaporized, the heating temperature distribution of the metal body is made uniform, thereby improving the durability.

In a microwave heating apparatus according to claim 16, the shaft member can be inserted into the hollow space in the metal body while the outer diameter of the shaft member is reduced. Thus, the attachment of the shaft member to the metal body becomes easy. After the shaft member is inserted into the hollow space in the metal body, the shaft member is pushed onto the inner wall of the metal body by the extending force of the spring. Thus, the shaft member is certainly secured. Since the adherence between the shaft member and the metal body is improved, the heated liquid is prevented from flowing out of the passage of the heat generating body. As a result, the efficiency of vaporization of the liquid by heating is improved.

In a microwave heating apparatus according to claim 17, the vapor generator is structured so as to pump the water up into the water supply tank by a pump through a water processing material cartridge attached to the water supply tank. Even if the microwave heating apparatus is operated without mounting the water processing material cartridge, water containing any scale component is not provided to the metal body. Thus, clogging of the metal body by malfunction can be prevented.

In a microwave heating apparatus according to claim 18, the control section notifies the time to exchange the water processing material cartridge. Thus, the microwave heating apparatus is prevented from operating beyond the time to exchange the water processing material cartridge. Moreover, it is possible to urge the user to exchange the water processing material cartridge before the function of the cartridge is deteriorated. This guarantees the long-time safe operation of the microwave heating apparatus.

In a microwave heating apparatus according to claim 19, the control section allows the operation of the pump under a specific condition after stopping the operation of the pump by detecting that the time to exchange the water processing material cartridge is approaching. Thus, the user can use the microwave heating apparatus even while preparing for a new water processing material cartridge. As a result, the work efficiency of the microwave heating apparatus is increased.

In a microwave heating apparatus according to claim 21, the control section notifies the water supply when a water level detector detects that the water level in the water supply tank has reached a detection level and still continues the operation of the vapor generator for a prescribed time period. Since the generation of the vapor is continued even after the water supply notification, interruption of a vapor-utilizing function can be avoided.

In a microwave heating apparatus according to claim 22, the water level detector can separate the liquid container from the vapor generator. Accordingly, supply of water to the liquid container and the washing of the liquid container can be conducted under a water faucet by separating the liquid container from the main body. Thus, the work load is alleviated and water splashing caused during work is prevented.

In a microwave heating apparatus according to claim 24, a waste water tank is provided at a lower posi of a main body of the microwave heating apparatus for receiving water from dew condensation in the heating chamber and the water discharged from the boiler of the vapor generator. Since the waste water can be collected in the waste water tank, operability is improved.

What is claimed is:

1. A microwave heating apparatus, comprising:

a heating chamber for accommodating an item to be heated;

a microwave generator for radiating microwaves to the heating chamber; and a vapor generator for supplying vapor to the heating chamber, wherein said vapor generator is configured such that the vapor is not in direct contact with the item to be heated, and further wherein the heating chamber includes a regenerating plate for generating and regenerating heat when radiated by the microwaves from the microwave generator, thereby reducing dew condensation caused by the vapor in the heating chamber.

2. A microwave heating apparatus according to claim 1, wherein:

the vapor generator includes an excitation coil provided outside a vapor generating chamber and a metal body provided inside the vapor generating chamber which is made of one of foam and fiber, and water from a water supply tank is drip-fed onto a top end of the metal body.

3. A microwave heating apparatus according to claim 2, wherein the vapor generating chamber includes a diffusive member for diffusing water drip-fed from the water supply tank.

4. A microwave heating apparatus according to claim 3, wherein the diffusive member includes an end surface diffusive member provided at an end surface of the metal body and an outer peripheral wall diffusive member provided on an outer peripheral wall of the metal body.

5. A microwave heating apparatus according to claim 4, wherein the outer peripheral wall diffusive member is formed of long-fiber assembly having an ability of absorbing liquid and an ability of retaining liquid.

6. A microwave heating apparatus according to claim 2, wherein:

the metal body includes a hollow space, and a shaft member is inserted into the hollow space for preventing water drip-fed from the water supply tank from flowing down from the hollow space without being vaporized.

7. A microwave heating apparatus according to claim 6, wherein the shaft member is a rolled cylindrical member which has a sufficient spring property to vary an outer diameter thereof.

8. A microwave heating apparatus according to claim 2, wherein the vapor generator is structured so as to pump the water up into the water supply tank by a pump through a water processing material cartridge attached to the water supply tank.

9. A microwave heating apparatus according to claim 8, further comprising a control section for determining time to exchange the water processing material cartridge based on the operation time of the vapor generator or the operation time of the pump for pumping up the water from the water supply tank, or the result of accumulation of amount of supplied water, and for notifying the time to exchange.

10. A microwave heating apparatus according to claim 8, further comprising a control section for stopping the operation of the pump by detecting that the time to exchange the water processing material cartridge is approaching and for allowing the operation of the pump only during a prescribed time period by detecting an input operation for instructing a re-start while the operation of the pump is stopped.

11. A microwave heating apparatus according to claim 8, further comprising an input device for inputting a set value for the time to exchange the water processing material cartridge.

12. A microwave heating apparatus according to claim 2, further comprising a control section for notifying water supply when a water level detector detects that a water level in the water supply tank has reached a detection level and for still continuing the operation of the vapor generator for a prescribed time period.

13. A microwave heating apparatus according to claim 12, wherein the water level detector includes a float having a buried magnet mounted in the water supply tank and a lead switch provided at a position separated from the water supply tank.

14. A microwave heating apparatus according to claim 12, further comprising:

a water processing material cartridge, having an inlet and an outlet, attached to the water supply tank;

wherein the detection level is above said inlet of the water processing material cartridge.

15. A microwave heating apparatus according to claim 1, wherein the regenerating plate is provided on at least one of top, bottom, left, right and inner rear walls included in the heating chamber.

16. A microwave heating apparatus according to claim 1, wherein the regenerating plate is on at least one of an upper position and a lower position with respect to a position at which the item to be heated is located in the heating chamber.

17. A microwave heating apparatus according to claim 1, further comprising a control section for pre-heating the regenerating plate to a prescribed temperature by operating the microwave generator prior to a supply of the vapor to the heating chamber from the vapor generator.

18. A microwave heating apparatus according to claim 1, wherein a vapor spraying outlet is provided for releasing the vapor upward from a lower position in the heating chamber.

19. A microwave heating apparatus according to claim 1, wherein a supporting plate is provided for covering a side wall of the heating chamber and supporting ends of the regenerating plate, and the regenerating plate has a vapor direction guide formed thereon for releasing the vapor upward to a position corresponding to a vapor spraying outlet formed at a lower position of the side wall of the heating chamber.

20. A microwave heating apparatus according to claim 1, wherein a length of the regenerating plate in a depth direction is shorter than a length of the heating chamber in the depth direction, and the heating chamber is structured so that air warmed by cooling a magnetron of a microwave generator flows in through a gap between at least one of the walls of the heating chamber and the regenerating plate which is set in the heating chamber.

21. A microwave heating apparatus according to claim 1, wherein a vapor spraying outlet formed at the lower position on a side wall of the heating chamber is connected to an outlet of a boiler of the vapor generator, and a lower level of the vapor spraying outlet is lower than a lower level of the outlet of the boiler.

22. A microwave heating apparatus according to claim 1, wherein the regenerating plate includes a plate formed of one of ceramics or porcelain and a glaze layer formed on a surface of the plate, the glaze layer generates heat when radiated by the microwaves, and the plate regenerates the heat which is generated by the glaze layer.

23. A microwave heating apparatus according to claim 1, further comprising a control section for pre-heating the heating chamber to a first target temperature by operating the microwave generator prior to the generation of the vapor generator when detecting a pre-heating start instruction while being in a wait state, and also for pre-heating the heating chamber to a second target temperature which is lower than the first target temperature when not detecting any action during a prescribed time period.

24. A microwave heating apparatus according to claim 1, wherein a waste water tank is provided at a lower position of a main body of the microwave heating apparatus for receiving water from the dew condensation in the heating chamber and the water discharged from the boiler of the vapor generator.

* * * * *